US006698958B2

(12) United States Patent
Emery et al.

(10) Patent No.: US 6,698,958 B2
(45) Date of Patent: Mar. 2, 2004

(54) SUBLIMATION SYSTEM AND METHOD

(75) Inventors: Monti Emery, Elmira, NY (US); Scott Chilson, Waverly, NY (US); David Whitley, Rock Hill, SC (US)

(73) Assignee: Paxar Corporation, White Plains, NY (US)

( * ) Notice: Subject to any disclaimer, the term of this patent is extended or adjusted under 35 U.S.C. 154(b) by 0 days.

(21) Appl. No.: 09/927,482

(22) Filed: Aug. 10, 2001

(65) Prior Publication Data

US 2003/0035675 A1 Feb. 20, 2003

(51) Int. Cl.[7] ..... B41J 11/26
(52) U.S. Cl. ..... 400/613; 101/488
(58) Field of Search ..... 400/120.01, 120.12, 400/120.14, 120.18, 611, 613, 621; 101/488; 347/212, 101, 102

(56) References Cited

U.S. PATENT DOCUMENTS

| | | | | | |
|---|---|---|---|---|---|
| 3,966,396 | A | * | 6/1976 | Howes et al. | 8/471 |
| 4,242,092 | A | * | 12/1980 | Glover | 8/472 |
| 4,314,814 | A | * | 2/1982 | Deroode | 8/471 |
| 4,541,340 | A | | 9/1985 | Peart et al. | |
| 4,640,191 | A | * | 2/1987 | Bradley | 101/470 |
| 4,776,714 | A | | 10/1988 | Sugiura et al. | |
| 4,912,486 | A | * | 3/1990 | Yumino | 347/212 |
| 5,015,324 | A | | 5/1991 | Goodwin et al. | |
| 5,150,130 | A | | 9/1992 | Sato | |
| 5,159,356 | A | * | 10/1992 | Sogu et al. | 347/115 |
| 5,721,581 | A | * | 2/1998 | Saito et al. | 347/249 |
| 5,746,521 | A | * | 5/1998 | Schoen et al. | 400/120.16 |
| 5,829,897 | A | * | 11/1998 | Murai | 400/615.2 |
| 5,874,982 | A | * | 2/1999 | Ueda et al. | 347/194 |
| 5,961,228 | A | | 10/1999 | Ward et al. | |
| 6,078,344 | A | * | 6/2000 | Wen et al. | 347/212 |
| 6,154,243 | A | * | 11/2000 | Tatewaki et al. | 347/223 |
| 6,206,589 | B1 | * | 3/2001 | Bjork et al. | 400/120.13 |
| 6,425,926 | B1 | * | 7/2002 | Hindriks et al. | 8/149.2 |
| 2001/0038411 | A1 | * | 11/2001 | Sasaki et al. | 347/212 |

FOREIGN PATENT DOCUMENTS

| | | | | |
|---|---|---|---|---|
| EP | 0 805041 | | 11/1997 | |
| JP | 61246070 A | * | 11/1986 | B41J/3/20 |
| JP | 06191102 A | * | 7/1994 | B41J/11/42 |
| JP | 09013284 A | * | 1/1997 | D06P/5/00 |
| WO | WO 99 51442 | | 10/1999 | |

OTHER PUBLICATIONS

Machine translation of JP 09013284 A from Japanese Patent Office website.*
Machine translation of JP 09013284 from Japanese Patent Office website.*
User Manual Paxar Model 676, Aug. 10, 2001, Manual Edition 6.3, Paxar Systems Group.
User Manual Paxar Lokprint, Oct. 2, 2000, Manual Edition 3.4, Paxar Systems Group.
Fabric Label Printing Systems Brochure, undated, Paxar, White Plains, NY.

* cited by examiner

*Primary Examiner*—Daniel J. Colilla
(74) *Attorney, Agent, or Firm*—Joseph J. Grass

(57) ABSTRACT

This invention relates to a system and method for sublimating at least one sublimation dye on at least one side of a web. The sublimation station includes a plurality of sensors which senses a web temperature and controls a plurality of heating elements, such as infrared lamps to control the web temperature so that it is maintained within a desired sublimation temperature range.

53 Claims, 21 Drawing Sheets

SUBLIMATION SYSTEM AND METHOD

FIELD OF INVENTION

This invention relates to a printing system and, more particularly, the invention relates to a process and apparatus for sublimating at least one sublimable dye on a substrate carrier that may be cut to provide a plurality of labels.

DESCRIPTION OF RELATED ART

In the past, printed fabric labels were made using a variety of well-known techniques, such as screen printing, off set lithography printing, dying, flexographic printing, thermal printing, ink jet printing, and the like. Several prior art methods and apparatuses for printing are disclosed in U.S. Pat. Nos. 4,776,714; 5,015,324; 5,150,130; 5,961,228; 4,640,191; and 4,541,340; and the Paxar Model 676 printer User Manual, all of which are incorporated herein by reference. Some of these methods and apparatuses lend themselves to use with large scale commercial printing equipment on which large sheets or webs of fabric are printed, and then cut or slit into strips for fabric labels. These labels are suitable for use in garments for the purpose of decoration, identification, advertising, wash and care instructions, size, price, as well as other purposes.

Product labels utilized in garments typically endure several hundred washings in their lifetime and a garment that is dry-cleaned might be required to endure dozens of cleanings in its lifetime. The abuse to which such labels are subjected during industrial washing and dry-cleaning causes fraying and eventually obliteration of conventionally printed labels; yet, printing of such labels is highly desirable because labels can be printed at much higher speeds than they can be woven.

Sublimation printing basically involves applying a sublimation dye onto a substrate, such as a surface of a fabric. To perfect the transfer of the dye to the fabric, the fabric is carried through a curing operation in which the fabric is heated to sublime the dye. In the past, the fabric was typically heated on only one side by feeding the fabric over, for example, an anvil or past a lamp. U.S. Pat. No. 4,541,340 illustrates another system that uses a Xenon flash lamp to heat a printed side of the web. One of the problems with these approaches was that the fabric was not evenly heated.

Another problem with prior art approaches to curing the sublimable dye was that the fabric temperature was not closely monitored or controlled so that, for example, at start up, the fabric would be fed through the curing station before it had an opportunity to reach the necessary sublimation temperature. It is not uncommon that the web stopped when the web jammed, an upstream printing operation stopped, or a downstream cutting and label stacking operation stopped. Moreover, if the web stopped, the web would be exposed to excessive temperatures that could damage the web.

SUMMARY OF THE INVENTION

It is a primary object of the invention to provide an improved system and method for sublimating at least one sublimation dye on one or both sides of a web.

Another object of this invention provides a system for sublimating at least one sublimation dye on at least one side of a web, the system comprising a controller for controlling operation of a sublimation station, a heater coupled to the controller and spaced from the web for heating said web to a sublimation temperature to sublimate the at least one sublimation dye, at least one sensor for sensing a web temperature, and the controller energizing the heater in response to the web temperature to maintain the web temperature at substantially the sublimation temperature.

Still another object of this invention provides a sublimation station comprising a frame, a heater driveably mounted on the frame, the heater comprising a heating area for receiving a web having at least one sublimation dye; the heater being in spaced relation to the web and heating the web to a sublimation temperature to sublimate the at least one sublimation dye, a controller coupled to the heater for controlling operation of the heater, at least one sensor coupled to the controller for sensing a web temperature and generating a web temperature signal in response thereto, and the controller energizing the heater in response to the web temperature signal to maintain the web temperature at substantially the sublimation temperature.

Yet another object of this invention comprises printing system for printing a plurality of labels, the system comprising a printing station for applying at least one sublimable dye to at least one side of the web, a sublimation station situated downstream of the printing station, the sublimation station comprising a controller for controlling operation of the sublimation station, a heater coupled to the controller and spaced from the web for heating the web to a sublimation temperature to sublimate the at least one sublimable dye on the web, at least one sensor for sensing a web temperature, and the controller energizing the heater in response to the sensed web temperature to maintain the web temperature at substantially the sublimation temperature.

Still another object of this invention comprises a method for sublimating at least one sublimation dye on a web comprising the steps of moving a heater from a park position to an operating position at which the heater is in spaced relation to the web, sensing a web temperature, and feeding the web through the heater, and energizing the heater to heat the web to a desired sublimation temperature to sublimate the dye.

Yet another object of this invention comprises a method for printing labels comprising the steps of printing at least one sublimable dye on a web of material as the web moves through a printing station; the sublimable dye defining a plurality of label patterns, sublimating the at least one sublimable dye using a heater in spaced relation to the web of material, the heater being continuously energized to provide sufficient heat to sublimate the at least one sublimable dye, and cutting the web of material to provide a plurality of labels.

Still another object of this invention comprises a method for printing a plurality of labels comprising at least one sublimation dye, the method comprising the steps of printing at least one sublimation dye on at least one side of a web to define the plurality of labels, driving a heater into operative and spaced relationship with the web, sensing a web temperature with a first sensor and energizing the heater in response to the sensed web temperature in order to maintain the web temperature within a desired sublimation temperature range as the web is fed past the heater.

Yet another object of this invention comprises a printing system comprising a printer for printing at least one sublimation dye on a web as the web is fed through the printer, a sublimation station for subliming and diffusing the at least one sublimation dye on the web as it moves through the sublimation station, the sublimation station comprising a frame, a heater assembly driveably mounted on the frame and moveable between a park position and an operating position during which the heater assembly is spaced from the web and may heat the web; the heater assembly being energized continuously while in the operating position, a drive motor for driving the heater assembly between the park and operating positions, a sensor for sensing a temperature of the web as the web is being fed through the heater assembly and generating a sensed temperature signal in response thereto, a controller for controlling operation of the printer and the sublimation station, the controller energizing the drive motor to drive the heater assembly between the park position and the operating position and controlling the heater assembly to maintain the web within a sublimation temperature range in response to the sensed temperature as the web moves past the heater assembly.

These and other objects and advantages of the invention will be apparent from the following description, the accompanying drawings and the appended claims.

DETAILED DESCRIPTION OF THE PREFERRED EMBODIMENT

Figure 1:
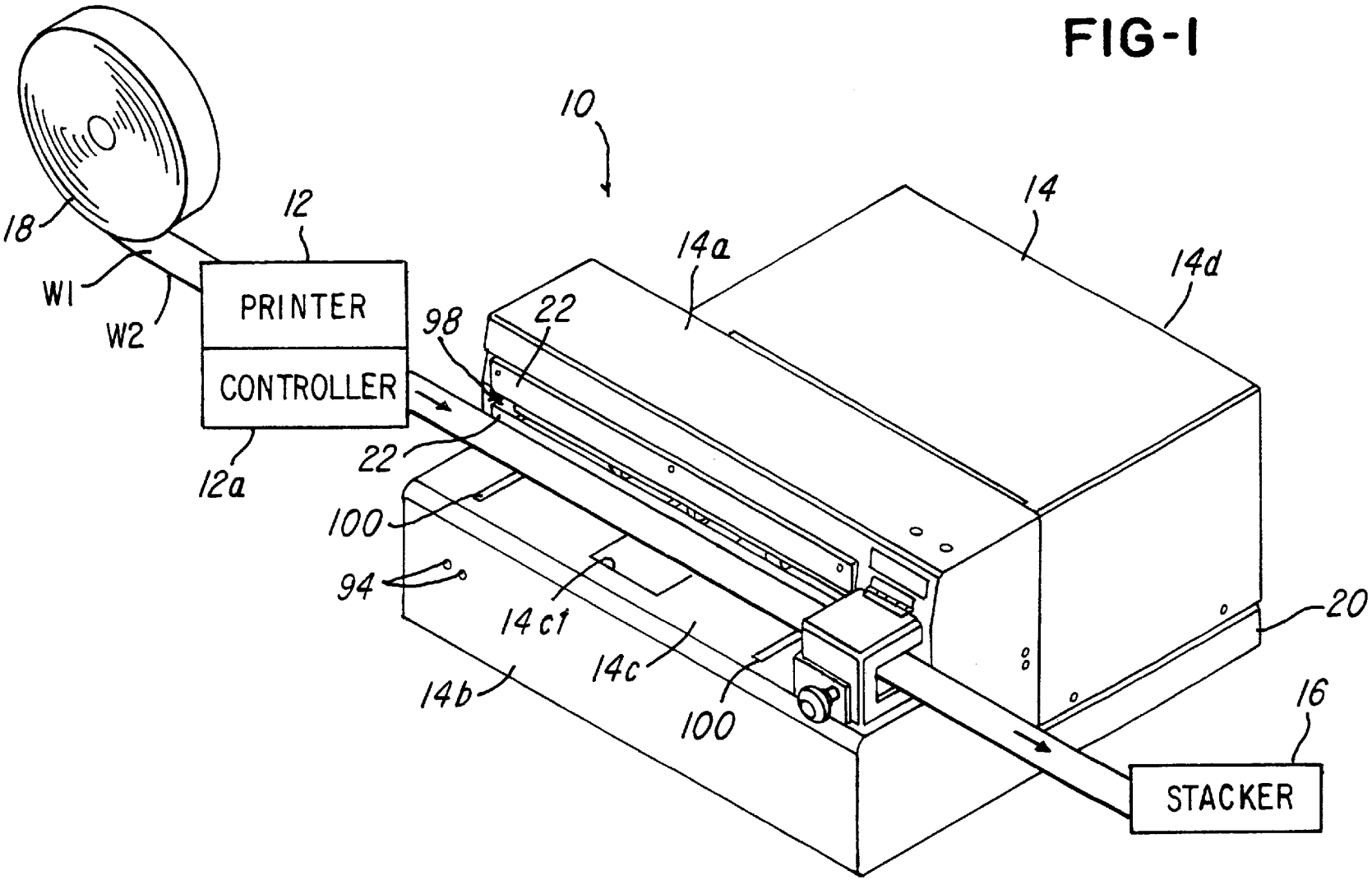
FIG. 1 is a perspective view of a printing and sublimating system in accordance with one embodiment of the invention, showing a heater in a home or park position.

Referring initially to FIG. 1, there is shown a label manufacturing system 10 for printing on one or both sides, W1 and W2, of a web W. The web W can be composed of fabric, such as is used to make garment labels and the like, or can be composed of paper, synthetic material, such as vinyl or plastic, or other materials.

Figure 14:
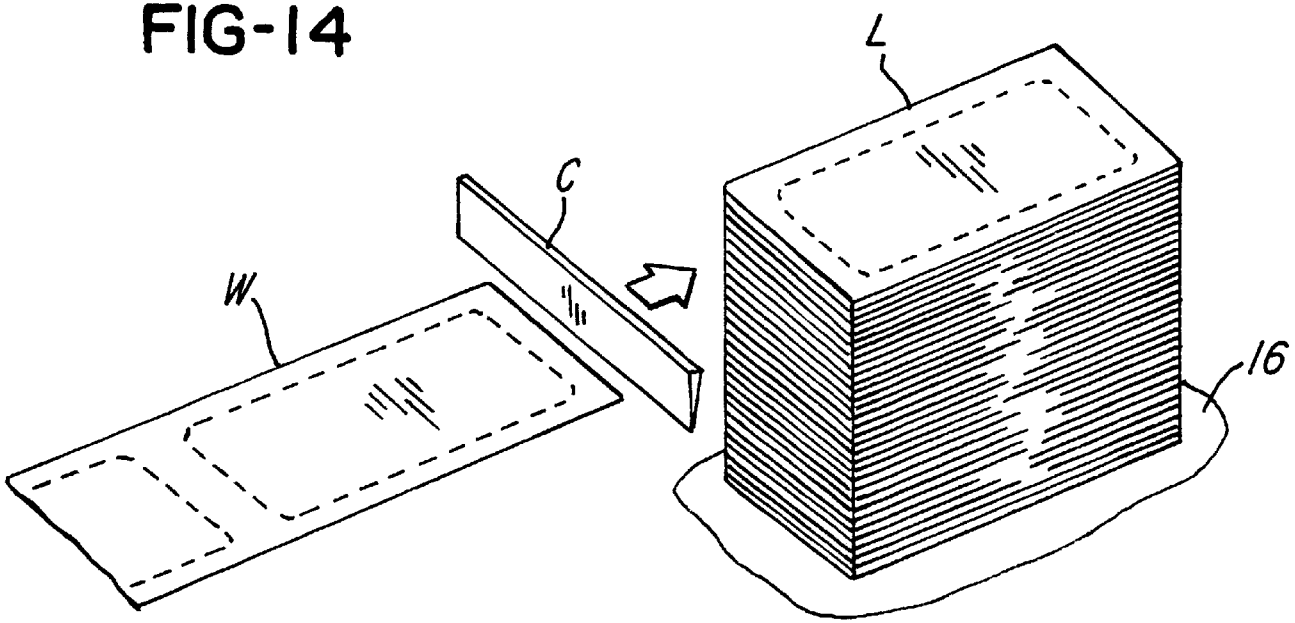
FIG. 14 is a fragmentary perspective view illustrating a plurality labels made in accordance with the system and methods described herein.

The system 10 comprises a printer 12 for printing or applying at least one sublimable dye on one or both sides W1 and W2; a sublimation station 14 for causing at least one dye in the web W to sublime or vaporize and diffuse into the web W; and a stacker 16 for cutting and stacking a plurality of labels L (FIG. 14) after the web W has been printed, sublimed and cut by a cutter C. In the embodiment being described, the printer 12 may be a Paxar Model No. 636® printer available from Paxar Corporation of White Plains, N.Y., the assignee of this application. Further, the stacker 16 may be the Paxar SS Finisher, also available from Paxar Corporation of White Plains, N.Y.

The printer 12 comprises a control system or controller 12*a* that is coupled to both the sublimation station 14 and stacker 16. In the embodiment being described, the controller 12*a* controls the operation of the entire system 10, as will be described in detail later herein. In general, the printer controller 12*a* controls the system 10 to cause the web W to be drawn from the supply roll 18 and the printer 12 prints on one or both sides W1 or W2 with at least one sublimable dye determined by the color or colors desired to appear on the finished label. The web W is then fed through the sublimation station 14 which sublimates or vaporizes the at least one sublimable dye to fix it into the web W. Thereafter, the web W is cut by the cutter C (FIG. 14) into the plurality of labels L (FIG. 14) and stacked by the stacker 16.

Figure 2:
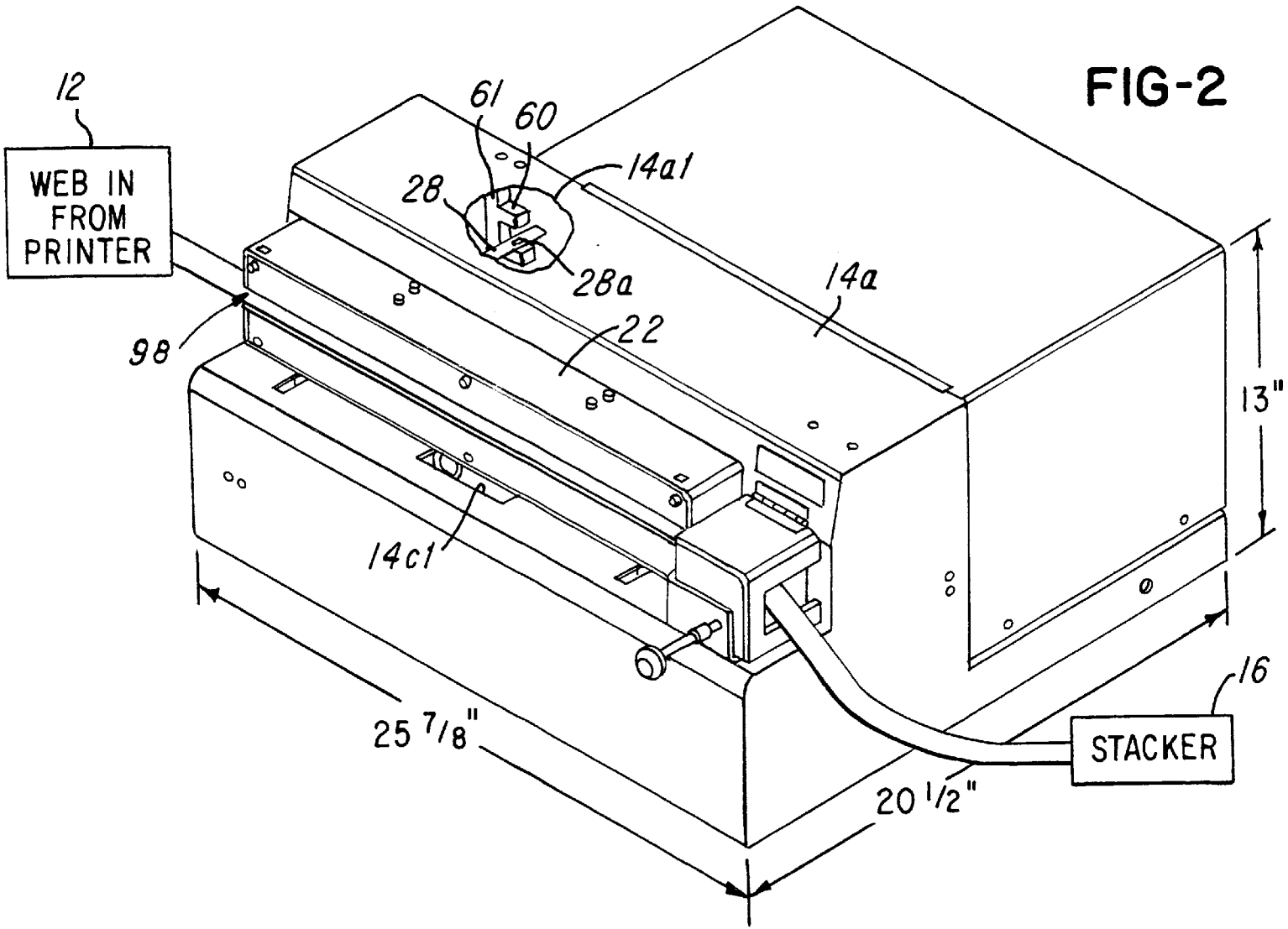
FIG. 2 is perspective view, similar to the view shown FIG. 1, showing the heater in an operating or extended position.
Figure 3:
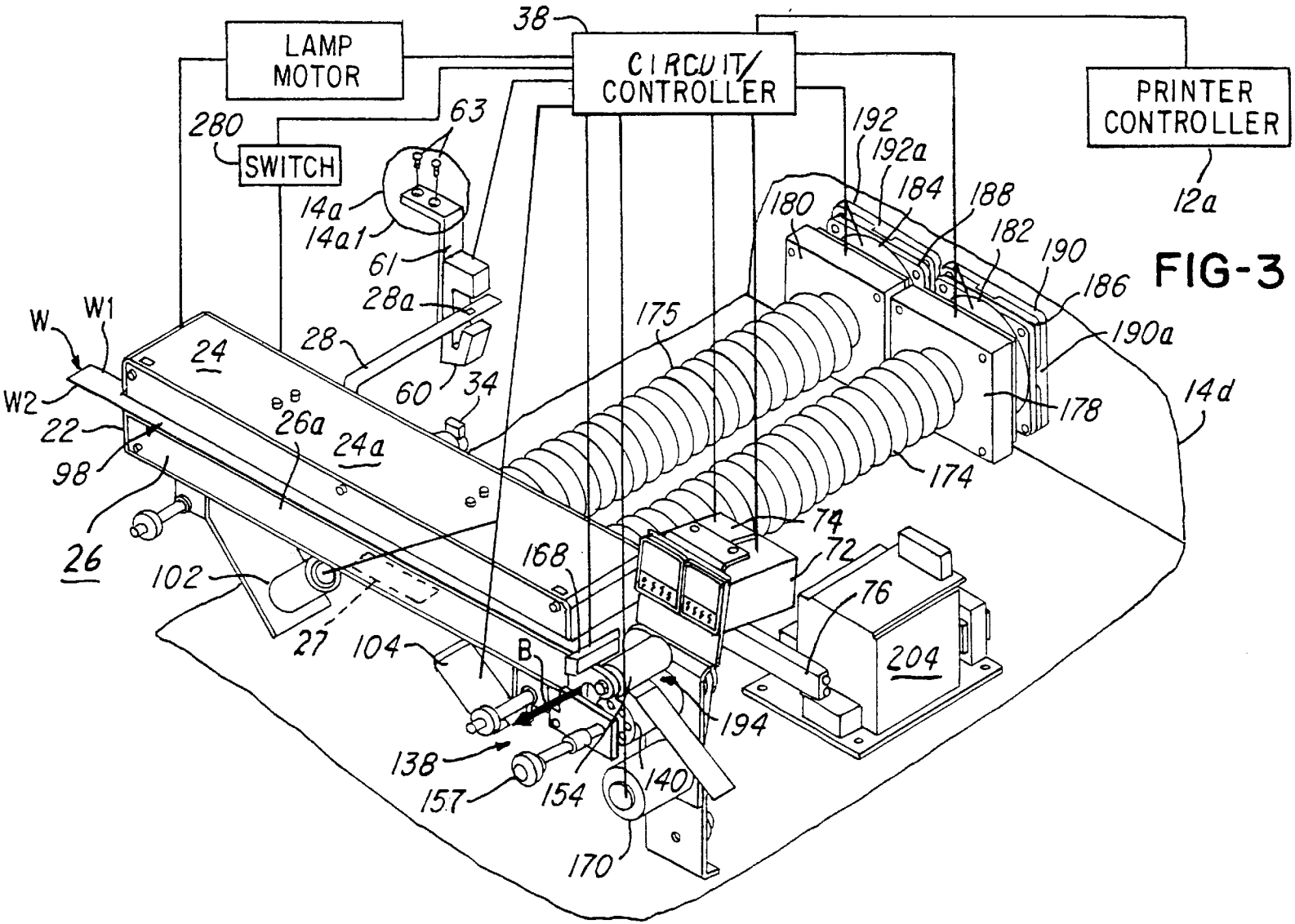
FIG. 3 is a fragmentary view showing various components of the internal components of the sublimation station.

The sublimation station 14 comprises a housing 20 comprising a heating system or a heater 22 which can be driven from a rest or home position, illustrated in FIG. 1, to an extended or heating position, illustrated in FIGS. 2 and 3. The heating system or heater 22 comprises at least one first lamp 24 comprising a first pair of lamp bulbs 68 (FIG. 5) and at least one second lamp 26 comprising a second pair of bulbs 70. In the embodiment being described, the first and second lamps 24 and 26 are opposed and face sides W1 and W2, respectively, when the web W is being fed through heater 22.

Figure 4:
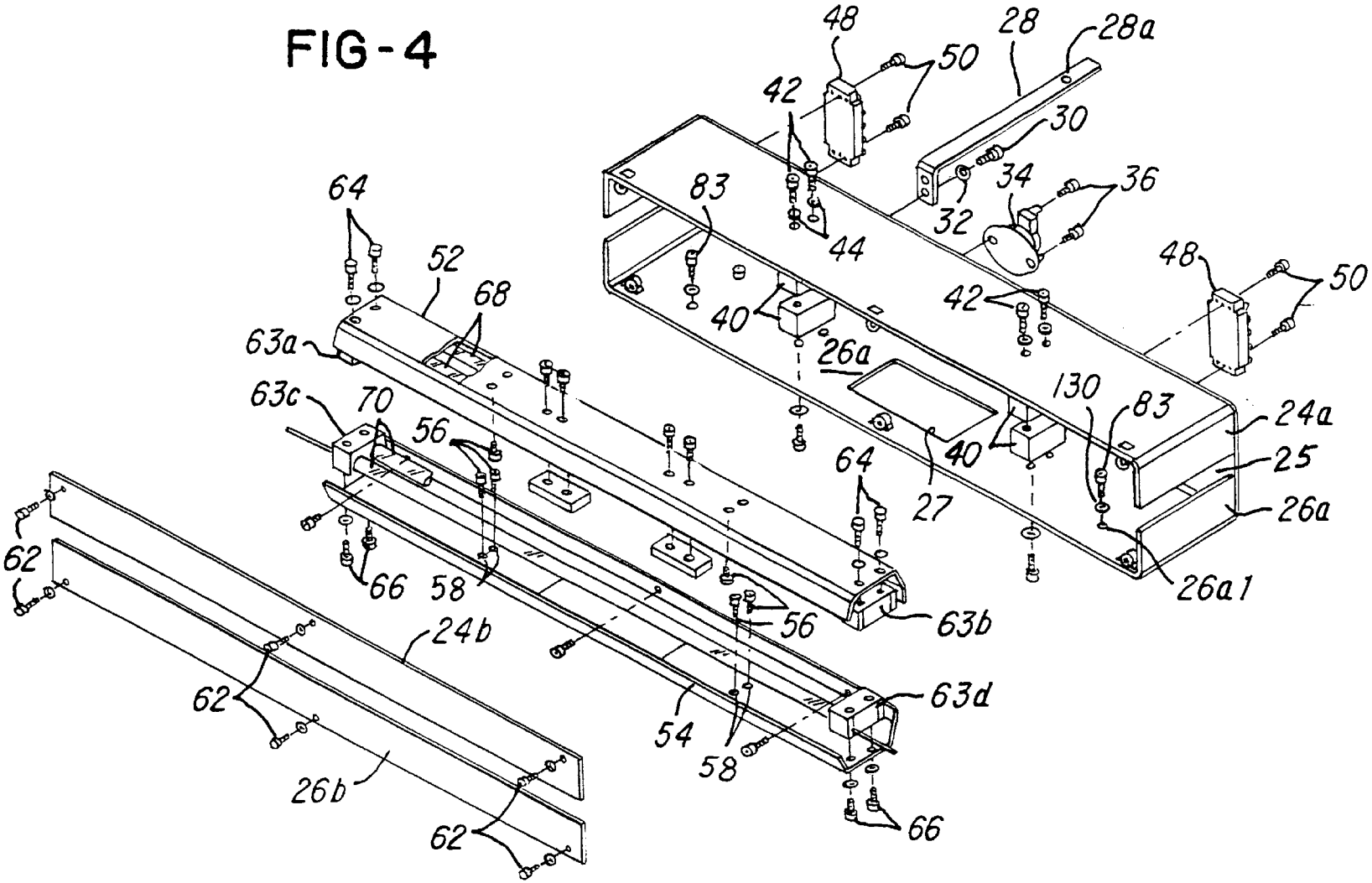
FIG. 4 is an exploded perspective view showing various components of the heater.

As best illustrated in FIG. 4, the first and second lamps 24 and 26 are substantially identical and comprise lamp covers 24*a* and 26*a*, respectively. A sensor or thermostat 34 (FIG. 4) is mounted to cover 24*a* with screws 36. The sensor 34 is coupled to a sublimation station 14 control circuit or controller 38 (FIGS. 3 and 11A) that controls the operation of the sublimation station 14. In the embodiment being described, the sensor 34 (FIGS. 3 and 4) terminates power to the lamps 24 and 26 if the temperature within the housing 14 generated by the heater 22 exceeds normal operating temperature.

As shown in FIG. 4, a plurality of mount guards 40 are secured to covers 24*a* and 26*a* with screws 42 and washers 44 as shown. In the embodiment being described, the mount guards or mounting blocks 40 maintain the pairs of bulbs 68 and 70 (FIG. 5) spaced from covers 24*a* and 26*a*. Terminal blocks 48 are mounted to a back panel 25 with screws 50. In the embodiment being described, the covers 24*a* and 26*a* and back panel 25 are an integral one-piece construction formed of sheet metal. The terminal blocks 48 provide terminals for various electrical components mentioned later herein. In the embodiment being described, the lamps 24 and 26 of heater 22 provide sufficient energy to heat the web W to the temperature required to sublimate the dyes.

The heater 22 further comprises bulb covers 52 and 54 (FIG. 4) that are mounted to lamp covers 24*a* and 26*a*, respectively, with screws 56 that pass through apertures 58 into mounting blocks 40.

The lamp cover 24*a* comprises a sensor bracket 28 mounted to cover 24*a* with screw 30 that passes through washer 32. The bracket 28 comprises a flag in the form of an aperture 28*a*. The aperture 28*a* cooperates with a heater 22 position sensor 60 (FIGS. 2 and 3) that is mounted to a bracket 61 that is in turn mounted to an underside 14*a*1 of a top surface 14*a* of the housing 14. In the embodiment being described, the sensor 60 senses the presence or absence of the aperture 28*a* and generates a signal indicating when the heater 22 is in or out of, respectively, the operating or heating position (illustrated in FIG. 2).

Referring back to FIG. 4, the lamps 24 and 26 comprise front panels or covers 24*b* and 26*b*, respectively, that are mounted to the covers 24*a* and 26*a* with screws 62 as shown. A first pair of lamp bracket mounts 63*a* and 63*b* are mounted to cover 52 with screws 64 threadably received in brackets 63*a* and 63*b*. A pair of second lamp bracket mounts 63*c* and 63*d* are mounted to cover 54 with screws 66 that are threadably received in mounts 63*c* and 63*d*. In the embodiment being described, the lamp bracket mounts 63*a* and 63*b* cooperate to receive the lamps bulbs 68, and the lamp bracket mounts 63*c* and 63*d* cooperate to receive the lamps bulbs 70, respectively. Although the embodiment being described is shown with two pairs of lamp bulbs 68 and 70, more or fewer bulbs may be used if desired.

Figure 11:
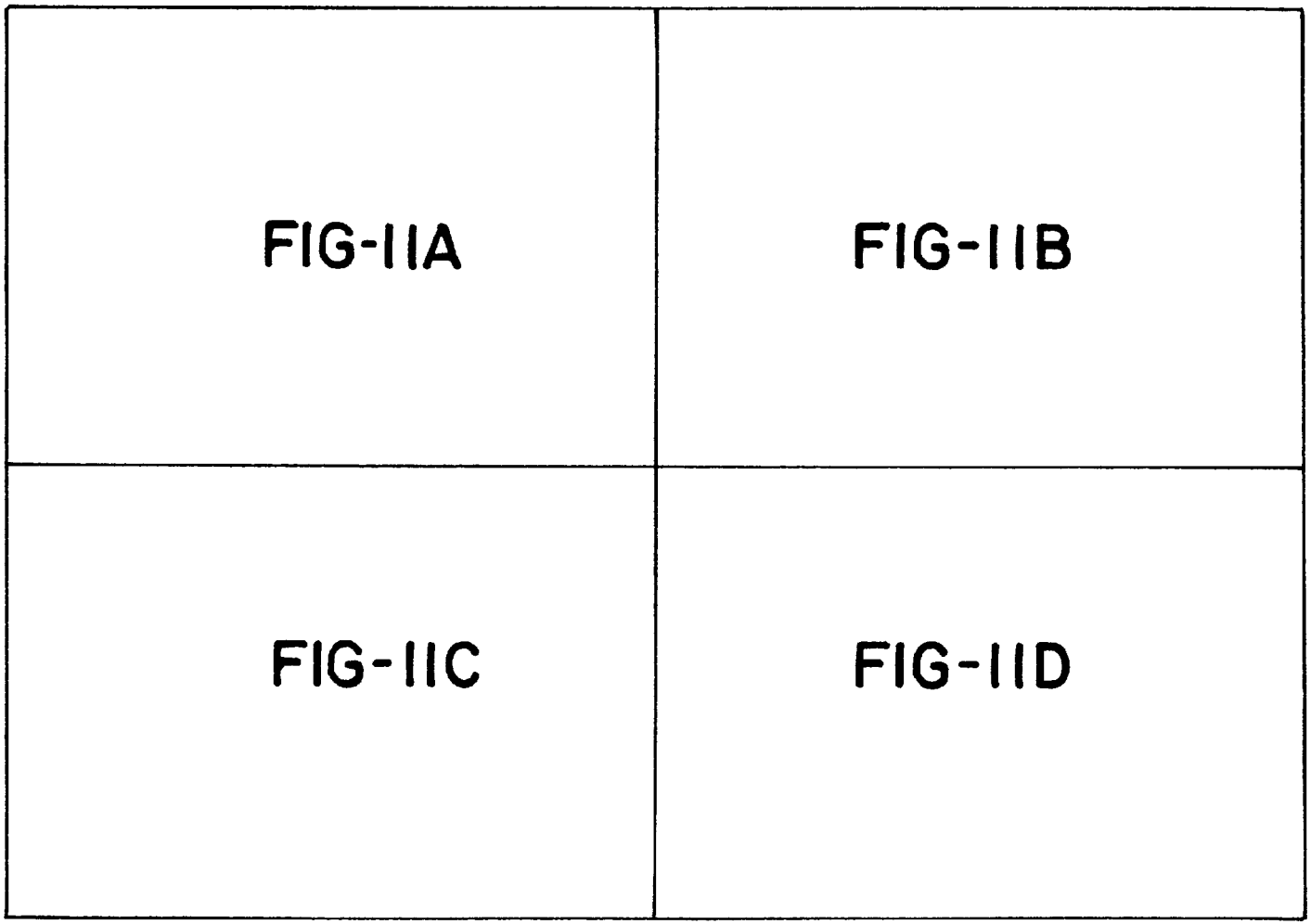
FIG. 11 is a view showing the layout of the circuit illustrated in FIGS. 11A–11D.
Figure 11A:
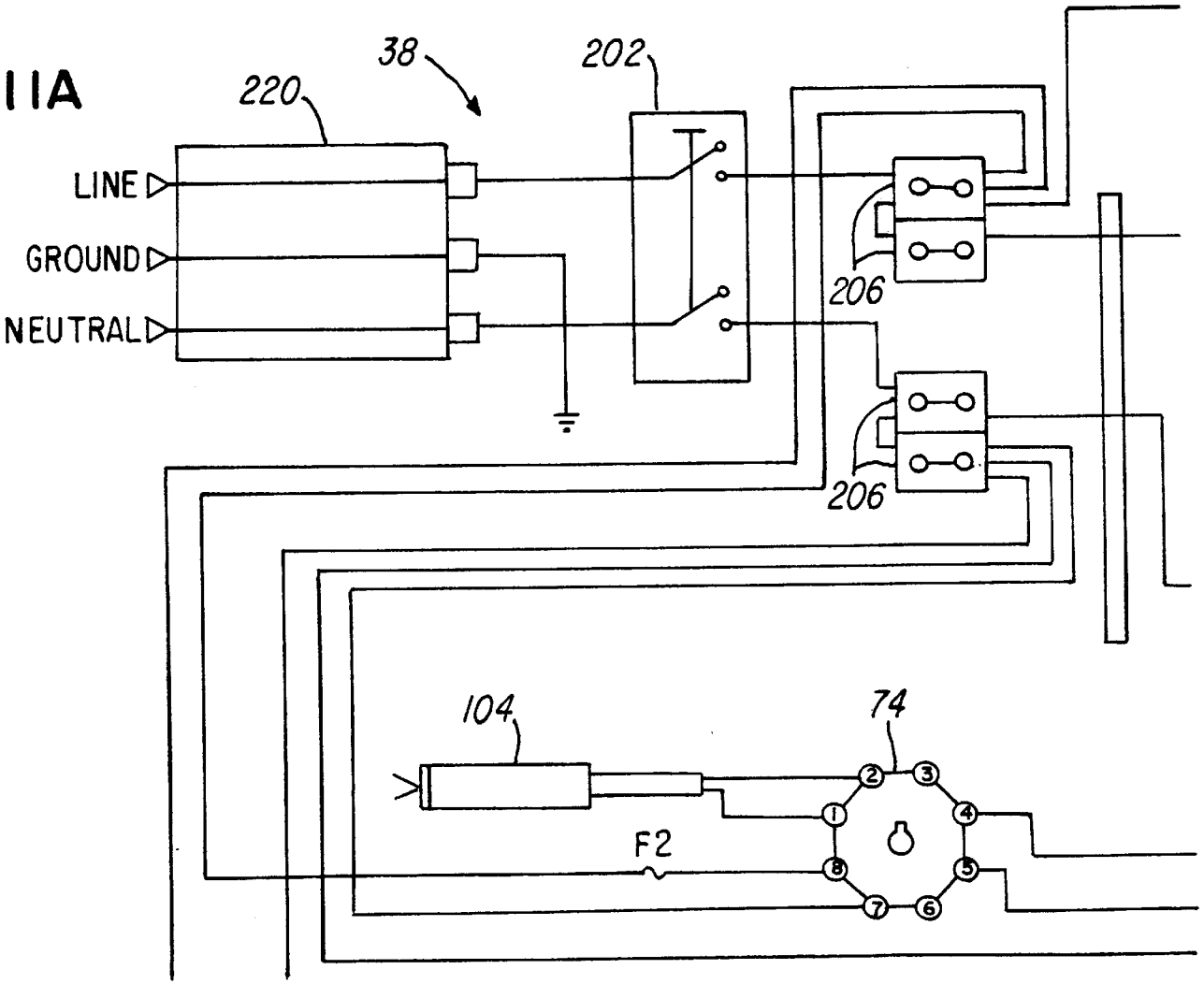
FIGS. 11A–11D is a circuit diagram of a control system used in the embodiment being described.
Figure 11B:
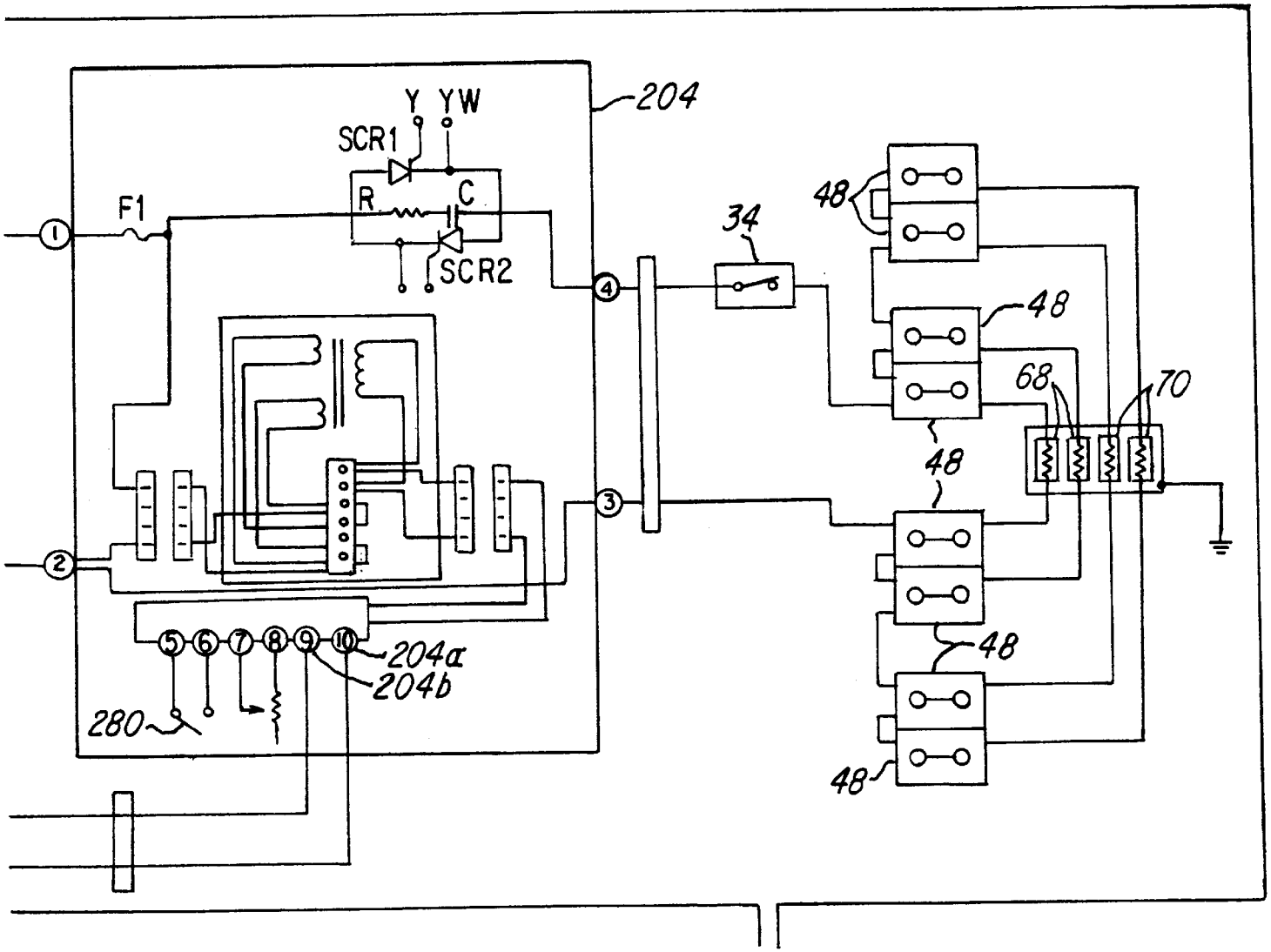
Figure 11C:
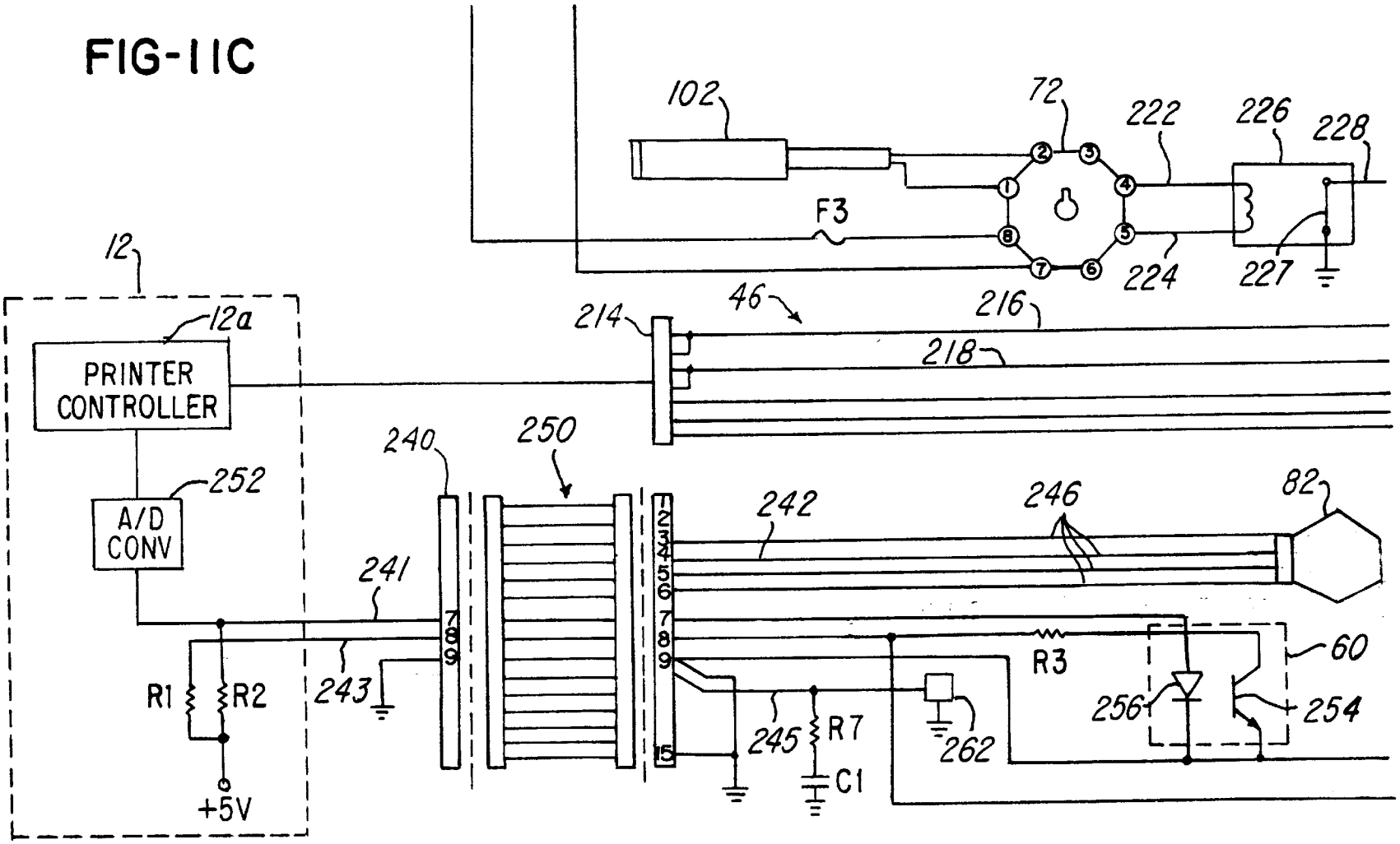

The at least one first and second lamps 24 and 26 are coupled to a silicon controlled rectifier (SCR) controller 204 (FIGS. 3 and 11B). A programmable pyrometer or controller 104 (FIG. 3) is connected to temperature controller 72 for controlling the actual temperature of the web W (FIG. 3) via its connection to SCR controller 204. The control loop from lamps 24 and 26 to web W controls the actual temperature of the web W to permit dye sublimation to occur. If the web W temperature is below the desired temperature, the pyrometer 104 notifies the temperature controller 72 which in turn notifies the SCR controller 204 (FIG. 11B). In response, the SCR controller 204 will increase the energy to the lamps 24 and 26 to increase the temperature of the heater 22. If the web W temperature is too high the opposite occurs. Another programmable pyrometer 102 (FIG. 3) is connected to temperature controller 74 for the purpose of monitoring the temperature of the web W to stop the heater 22 if the temperature of the web W falls below a minimum required temperature. The sublimation temperature and the desired range at which the sublimation dyes on the web W will be sublimated will vary depending on such things as the type of labels being manufactured and the sublimation dyes being used.

During operation of the system 10, the heater 22 and lamps 24 and 26 are moved substantially simultaneously in the direction of double-arrow A (FIG. 5) between the park position and the operating position. To effect this movement, the system 14 comprises heater drive system 23 that will now be described relative to FIGS. 5–9. The drive system 23 (FIG. 7) comprises a support bracket 76 that is mounted between walls 14*c* and 14*d* (FIGS. 6 and 7) with screws 85. A pair of carriage shafts 78 and 79 (FIGS. 6, 7 and 9) are received in linear bearing mounts or blocks 80 and 81. The bearing blocks 80 and 81 are mounted to and cover 26*a* (FIG. 4) with screws 83 that pass through washers 130 and apertures 26*a*1 of cover 26*a*. The bearing blocks 80 and 81 further comprise a raised shoulder or projection 80*a* and 81*a*, respectively. These projections are received in slots 100 (FIG. 1) of surface 14*c* of housing 14 to permit the mounts 80 and 81 to support the heater 22 and travel in the slots 100 between the park and operating positions mentioned earlier herein.

Figure 7:
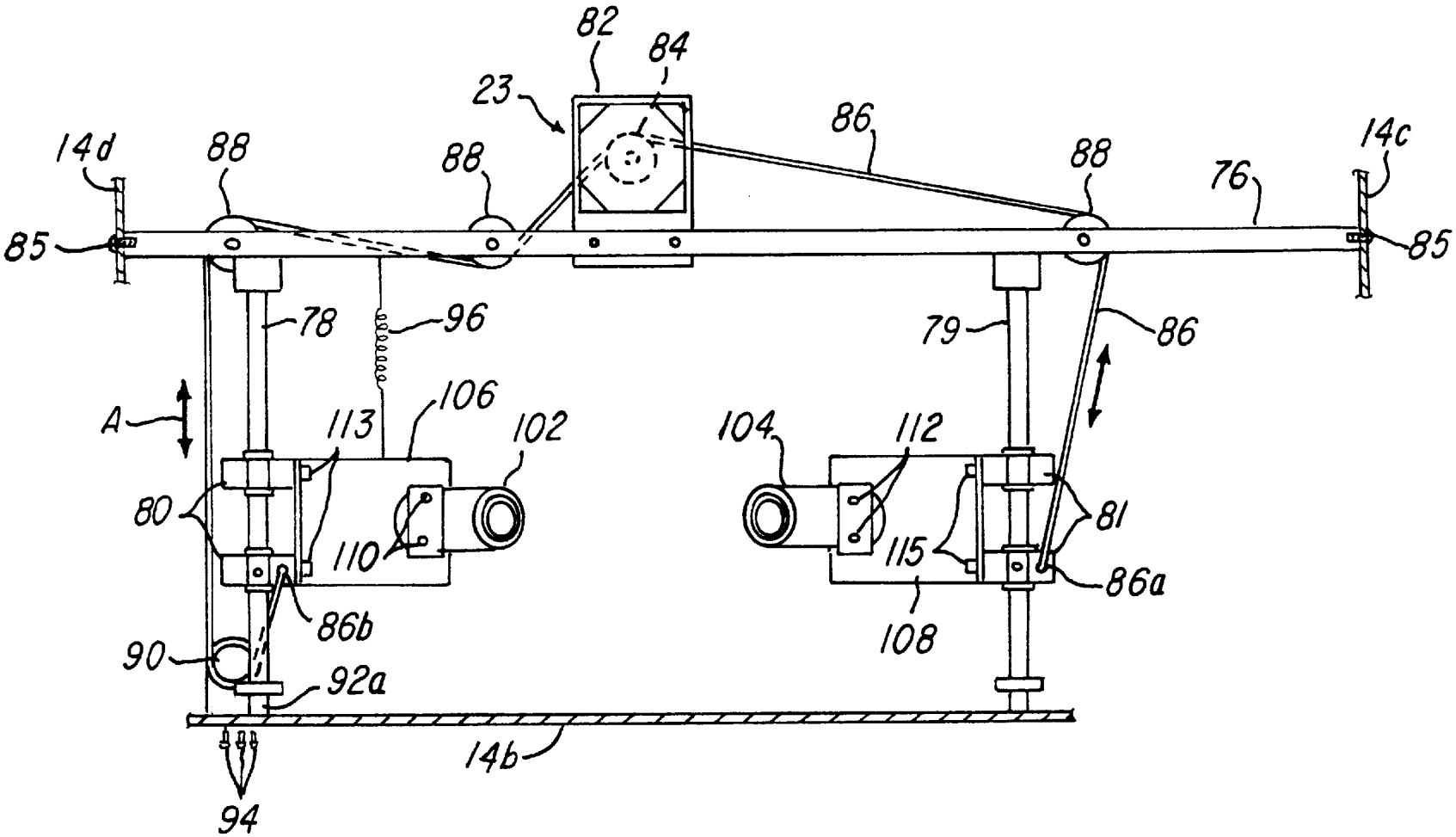
FIG. 7 is fragmentary plan view illustrating various details of the sensors and drive system.

FIG. 7 is a top view of the drive assembly with the heater 22 removed from the bearing blocks 80 and 81 for ease of illustration. The bearing blocks 80 and 81 (FIGS. 7 and 9) are coupled to a drive motor 82 with a drive cable 86 and enable the heater 22 to be driven in the direction of double-arrow A in FIG. 5. It should be understood that the drive motor 82 comprises a capstan 84 mounted on a drive shaft (not shown). As illustrated in FIG. 7, a plurality of pulley wheels 88 are mounted on the bracket 76 as shown. A pulley wheel 90 is mounted on a bracket 92 (FIG. 5) that has an end 92*a* mounted to a front panel 14*b* (FIGS. 1 and 7) of housing 20 with screws 94. As best illustrated in FIG. 7, the ends 86*a* and 86*b* of cable 86 are fastened to at least one of the respective bearing mounts 80 as shown.

The system 14 comprises a spring 96 (FIG. 6), which resiliently biases the bearing blocks 80 and 81 and, consequently, heater 22 in the park or retracted position (illustrated in FIG. 1), such as when power to the drive motor 82 is terminated. During operation, the heater drive motor 82 is energized to wind the drive cable 86 on capstan 84 which in turn causes the bearing blocks 80 and 81 to move away from bracket 76 (as viewed in FIG. 7) until the heater 22 is in the extended or heating position shown in FIGS. 2 and 3. The heater 22 defines a generally elongate receiving area or slot 98 (FIGS. 1, 2, 3 and 8), which receives the web W when the heater 22 is in the heating position illustrated in FIG. 2. As best illustrated in the view shown in FIG. 8, the web W is tensioned in the manner described later so that it is situated substantially equidistant between the pairs of bulbs 68 and 70 as illustrated. This facilitates heating both sides W1 and W2 of the web W substantially evenly.

Figure 9:
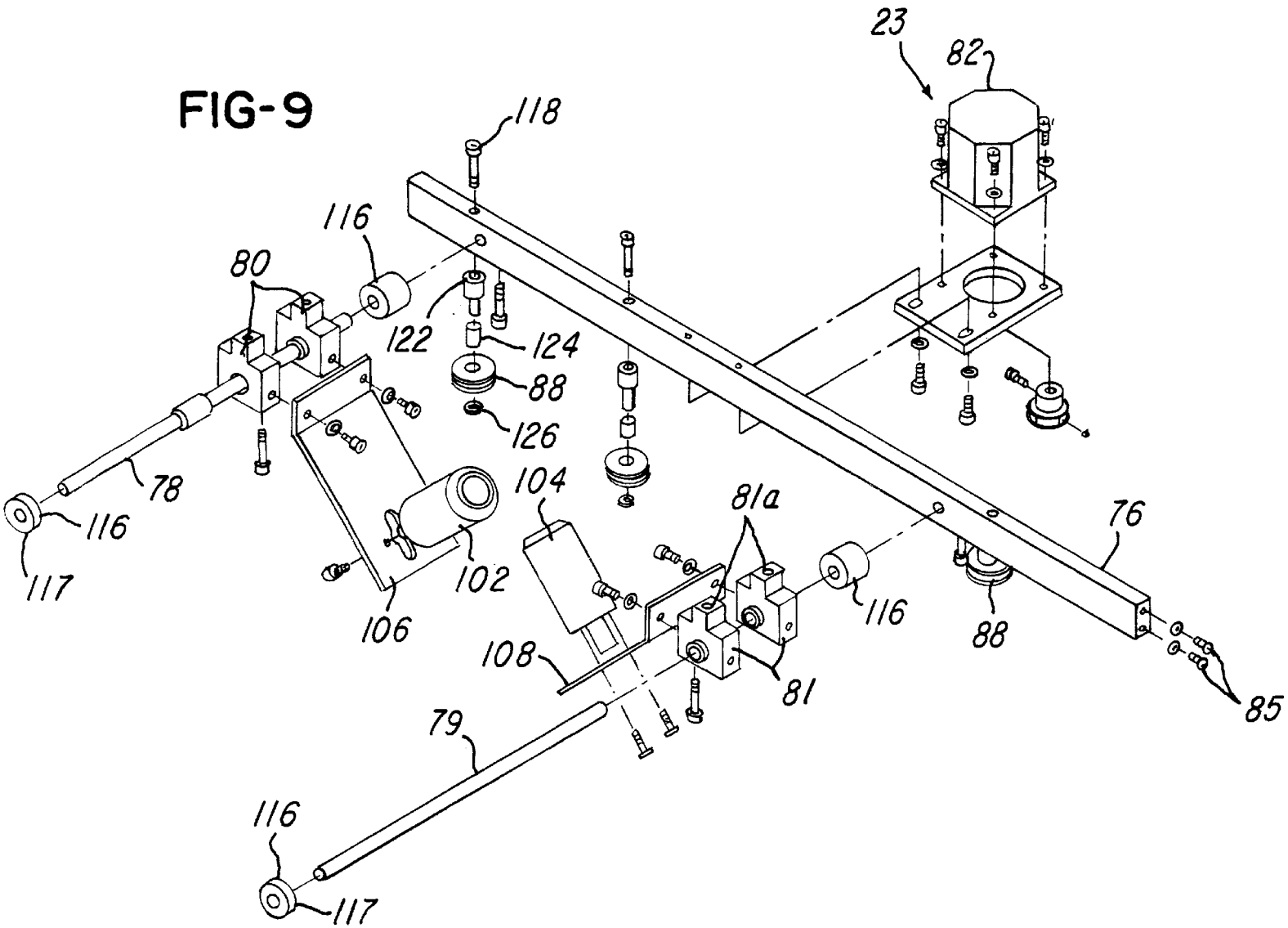
FIG. 9 is an exploded view illustrating the various components of the sensing system shown in FIG. 7.

FIG. 9 illustrates further details of the drive assembly for driving the heater 22. Bushings 116 are received on shafts 78 and 79 and positioned between bearing blocks 80 and 81 and bracket 76. Pulley wheel 88 is secured to bracket 76 with a cap screw 118 which secures a pulley shaft 122 having a bushing 124 and the pulley wheel 88 mounted thereon. A snap ring 126 secures the pulley wheel 88 to the pulley shaft 122.

In the embodiment being described, the system 10 comprises a sensing system or means for controlling the output of the lamps 24 and 26 and, consequently, the web W temperature. In this regard, the system 10 comprises at least one first sensor 102 coupled to the controller 74 mentioned earlier and at least one second sensor 104 coupled to controller 72, as shown in FIGS. 3–7 and 9. The sensors 102 and 104 are secured to the brackets 106 and 108, respectively, with screws 110 and 112 (FIG. 7), and brackets 106 and 108 are secured to the bearing blocks 80 and 81 with screws 113 and 115 as shown. The sensors 102 and 104 are aimed at the aperture 14*c*1 of surface 14*c* (FIGS. 1 and 2) and aperture 27 (FIG. 3) of lamp cover 26*a* to capture or sense the temperature of the heater 22 and web W as described later.

Referring to FIG. 9, bushings 117 are also situated on shaft 78 to separate the front wall 14*b* (FIG. 7) of housing 14 from the bearing mounts 80.

Figure 5:
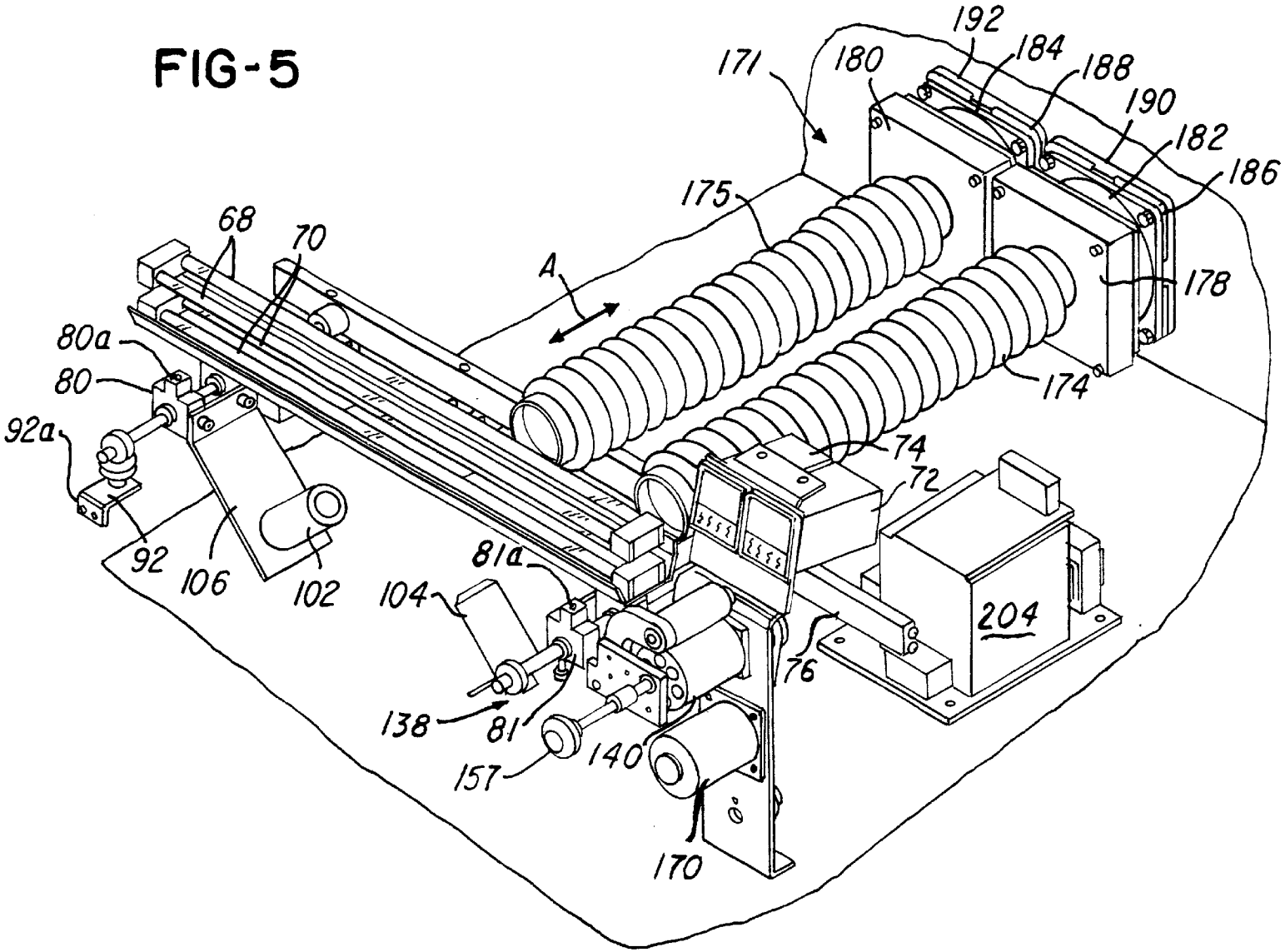
FIG. 5 is a fragmentary view showing further details of the components shown in FIG. 3 with all heater covers removed.
Figure 6:
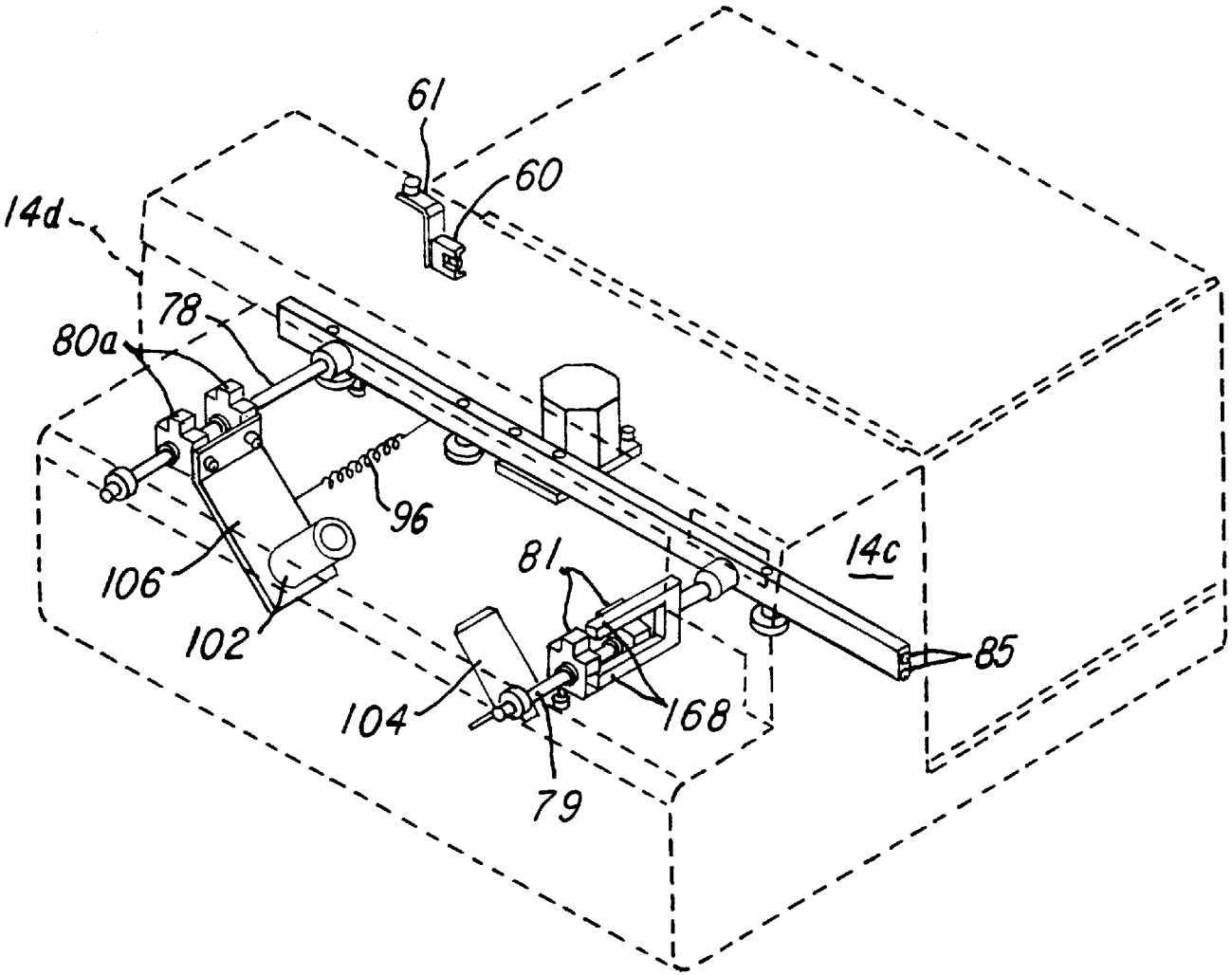
FIG. 6 is a perspective phantom view illustrating various details of the sensors used in the sublimation station.
Figure 10:
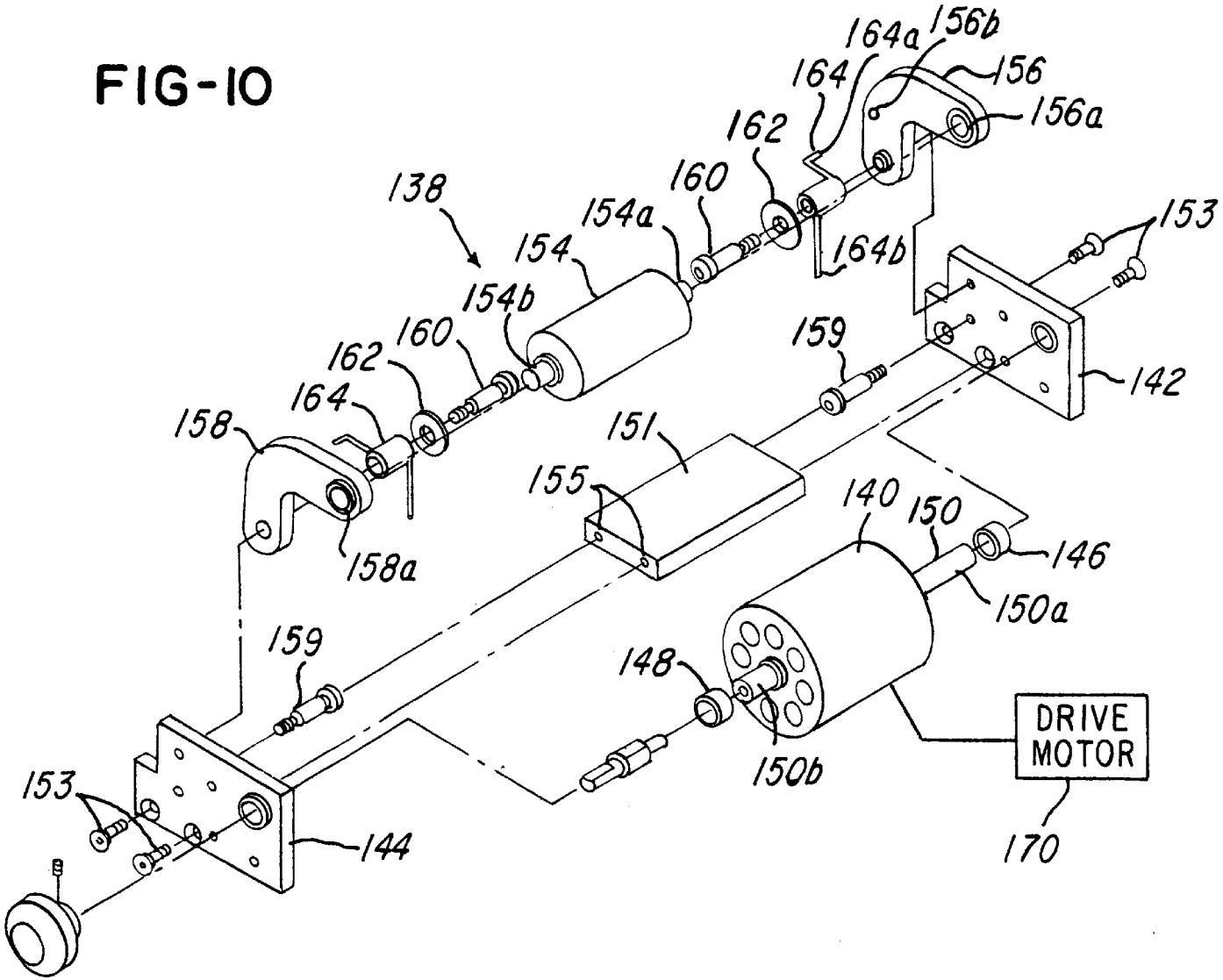
FIG. 10 is an exploded perspective view showing details of a feed drive assembly.

FIGS. 3, 5 and 10 illustrate a feed assembly 138 for feeding web W through the station 14. The feed or drive assembly 138 comprises a driven roll 140 situated between a first mounting plate 142 and a second mounting plate 144. The driven roll 140 comprises a shaft 150 having a first end 150*a* and a second end 150*b* which are received in the bushings 146 and 148, respectively. A bracket base plate 151 is mounted between the first and second brackets 142 and 144 and connected to the plate 151 with screws 153 are threadably received in threaded holes, such as holes 155 in the plate 151.

The feed assembly 138 further comprises a roller 154 that cooperates with driven roll 140 to drive or feed web W through sublimation station 14. The roller 154 comprises a first end shaft 154*a* and a second end shaft 154*b* that are rotatably received in a first aperture 156*a* and a second aperture 158*a*, respectively, of the L-shaped members 156 and 158. The L-shaped members 156 and 158 each comprise a bolt 160 that receives a washer 162 and springs 164 that secures the L-shaped members 156 and 158 to the brackets 142 and 144, respectively. The springs 164 comprise a bent end 164*a* received in aperture 156*b* in arm 156 and an end 164*b* that engages screw 159. The springs 164 resiliently bias the roll 154 against the driven roll 140, as shown in phantom in FIG. 8.

As illustrated in FIG. 3, the feed assembly 138 comprises a jam sensor 168, which senses the presence or absence of the web W, as well as if the web W is jammed. As will be described in detail later herein, if the web W is not present, the sensor 168 generates a signal ultimately received by the printer controller 12*a* so that the sublimation system 14 will not start, or if it has previously started, the system 10 will respond by retracting the heater 22 to the park position shown in FIG. 1. Also, if the web W should break during operation, the sensor 168 will sense this condition and also cause the heater 22 to be retracted. The process of operating the sensors 34, 60, 102,104, 108 and 168 will be described in more detail later herein relative to FIGS. 11A–11D.

In a manner conventionally known, the feed assembly 138 further comprises a feed motor 170 (FIGS. 3 and 10) that is operatively coupled by at least one belt and pulley (not shown) to the driven roll 140 to drive the roll 140 to feed the web W from the printer 12, through the sublimation station 14, and to a subsequent operation, such as a cutting and stacking operation.

As best illustrated in FIGS. 3 and 5, the system 14 comprises an air filter assembly 171 comprising a pair of vent hoses 174 and 175 that open to a pair of brackets 178 and 180, respectively. A pair of exhaust fans 182 and 184 exhaust air from the elongate area 98 (FIG. 3) through at least one filter 186 and 188, respectively. A pair of filter caps or shrouds 190 and 192 comprise a plurality of detents 190*a* and 192*a* for securing the at least one filters 186 and 188 to the exhaust fans 182 and 184 as shown. The filter shrouds 190 and 192 are removably secured to the exhaust fans 182 and 184 to permit removal or replacement of the filters 186 and 188, respectively, as needed. The exhaust fans 182 and 184 are vented through a pair of apertures (not shown) on a back wall 14*d* (FIGS. 1 and 3) of system 14.

Figure 11D:
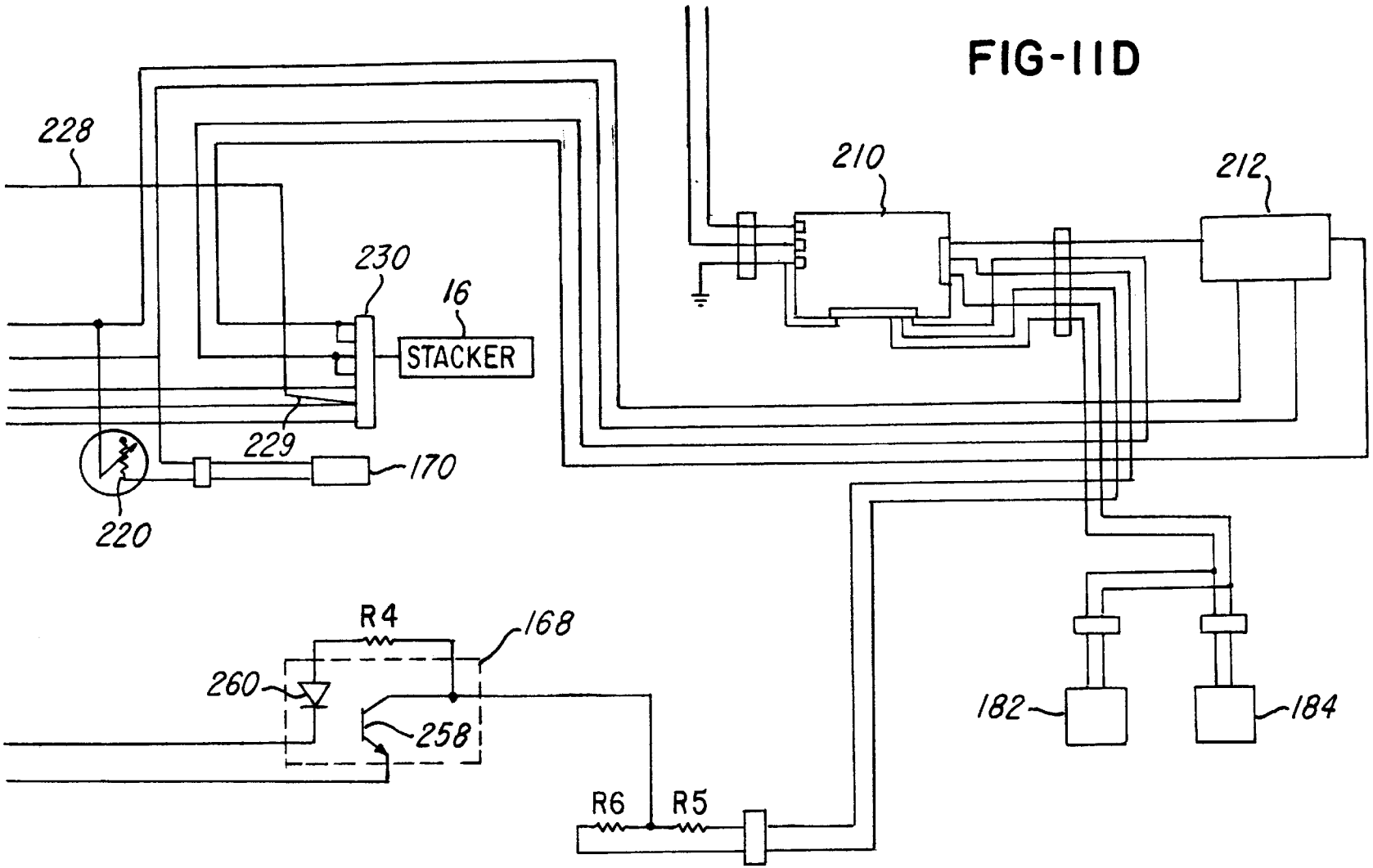

The system 14 controller 38 and its operation with printer controller 12*a* will now be described relative to FIGS. 11–11D. The controller/control circuit 38 comprises a conventional AC entry terminal 220 which is coupled to a circuit breaker 202 which in turn is coupled to the SCR controller 204 via conventional terminal blocks 206. The SCR controller 204 is coupled to bulbs 68 and 70 through terminal blocks 48 and the thermostat 34 mentioned earlier herein. The terminal blocks 206 are further coupled to a power supply 210 which provides as its output a 24-volt DC voltage for powering various components, such as the fans 182 and 184.

The relay 212 is also coupled to a seven-pin conventional microplug 214 which is coupled to stacker 16 as shown. The feed motor 170 is powered off lines 216 and 218 and is controlled by a rheostat 220 for controlling and setting the speed at which the motor 170 drives the web W through the sublimation station 14.

Controller 204 comprises a pair of input terminals 204*a* and 204*b* that receive input from controller 72 which in turn is coupled to sensor 104. In the manner described later herein, the controller 72 provides control input to controller 204 for controlling the power provided to lamps 68 and 70 during normal sublimation operation. Likewise, the sensor 102 is coupled to solid state relay 226 through controller 74. In the embodiment being described, sensor 102 detects the temperature of the web W when the heater 22 is in the heating or operating position (FIGS. 2 and 3) and a temperature of the heater 22 when the heater 22 is in the park position (FIG. 1). Both sensors 102 and 104 are infrared sensors that sense infrared radiation through aperture 14*c*1 (FIGS. 1 and 2). If the web temperature sensed by sensor 102 is at a desired set point or within the desired sublimation temperature range, using the controller 74, then the web W is continued to be fed through the station 14. If, however, the temperature of the web W is not within the desired temperature range for sublimating the at least one sublimation die on the web W, then controller 72 transmits a signal via lines 222 and 224 to a normally closed solid state relay 226. The relay 226 opens the normally closed gate 227 to generate an "OUT-OF-RANGE" signal on line 228 that is received by printer controller 12*a* via stacker 16. The sublimation station 14 includes the seven-pin receptacle 230 which is coupled to stacker 16. The line 228 is coupled to the line (not shown) of stacker 16 so that when relay 226 provides the "OUT-OF-RANGE" signal on line 228, the printer 12 receives the signal and responds in the same manner as when a "STACKER FULL" signal is received. Namely, the printer 12 immediately terminates power to the web feed motor 82 and motor 170. This causes the web W to stop moving through the printer 12. With power to motor 82 terminated, the spring 96 (FIG. 7) retracts the heater 22 to the home position shown in FIG. 1. It should be appreciated that the sublimation station 14 is attached and controlled by the printer controller 12*a*. The printer controller 12*a* has a standard peripheral interface 240 and is capable of supplying approximately 1.5 amps of current on line 241. The "OUT-OF-RANGE" signal is an input from control circuit 38 to printer controller 12*a* and functions similar to a conventional "STACKER FULL" signal. When the printer controller 12*a* receives this signal, the printer 12 will stop printing if it is already printing or will ignore operator requests to start printing if the printer 12 is idle. The printer 12 will generate and display an error message as long as the signal is asserted on line 228. This line 228 is pulled up to a logic high within the printer 12 and any peripheral attached to the printer 12 can assert an error condition or notice by pulling this line 228 down to a logic low. This allows multiple peripherals such as the sublimation station 14 and the stacker 16, to be attached to and signal the printer controller 12*a* by asserting or using this line 228. In the embodiment being described, the line 228 is connected to printer 12 via receptacle 230.

The printer controller 12*a* is coupled to the heater 22 drive motor 82 via a bipolar stepper motor drive channel 46. The circuit 38 further comprises a sensor channel comprising a standard optocoupler interface 250. The printer 12 comprises a pair of resistors, labeled R1 and R2 in FIG. 11C, which are coupled to lines 241 and 243, as shown. Line 241 is also connected to an analog-to-digital converter 252 for converting analog signal on line 241 to a digital signal for use by the printer controller 12*a*.

Circuit 38 comprises a resistor R3 that is coupled to a phototransistor 254. A light emitting diode (LED) 256 is situated in opposed relation to the transistor 254 to provide the sensor 60 (FIG. 3). Similarly, the sensor 168 (FIG. 11D) comprises the phototransistor 258 and opposed LED 260. The LED 260 is coupled to a fourth resistor R4 (FIG. 11D) which is coupled to a fifth resistor R5 and a sixth resistor R6 and a power supply 210 as shown. The circuit 38 further comprises a resistor R7 and capacitor C1 which are coupled in series and connected to line 245. In the embodiment being described, the printer controller 12*a* may determine the type of sublimation system to which it is coupled by applying a current on line 262 and monitor the change in the voltage state to determine whether the sublimation station 14 which is coupled to the printer 12 is of the type shown and described herein or of a predecessor model, such as Paxar Model No. 636® Lokprint, available from Paxar Corporation of White Plains, N.Y.

An electronically erasable programmable read only memory (EEPROM) 262 is also coupled to line 245, but is non-functional in the embodiment being described. Also, a plurality of fuses F1, F2 and F3 may be provided to protect the controller 38 from overload. The operation of the controller 38 and printer controller 12*a* will now be described.

In general, the sensors 102 and 104 monitor the temperature of the web W or the temperature of the heater 22. Sensor 104 operates independent of the sensor 102, which monitors the temperature of the web W at start up and the temperature of the heater 22 when the heater is in the home or park position. For example, when printer 12 is applying at least one sublimation dye to at least one side W1 or W2 of web W as it is fed through printer 12, the heater 22 is driven to the operating position illustrated in FIGS. 2 and 3. At any point when the printer 12 is stopped, the printer controller 12*a* terminates power to motor 82, whereupon spring 96 causes the heater 22 to retract to the home position (FIG. 1). This facilitates preventing the heater 22 from overheating or burning the web W.

While in the rest position, the sensor 102 senses the temperature of the heater 22 to determine if the heater 22 temperature is at the desired temperature set in controller 72. The output of the sensor 102 is coupled via controller 74 and solid state relay 226 to line 229 of the connector 230 mentioned earlier herein. If the temperature sensed by sensor 102 is outside the desired range, then controller 72 causes the relay 226 to generate the "OUT-OF-RANGE" signal on line 22 that functions like a conventional "STACKER FULL" signal mentioned earlier herein. The printer controller 12*a* receives this signal and stops the printing operation and simultaneously terminates power to motor 170. This causes the web W to cease moving through sublimation station 14. Substantially simultaneously, the printer controller 12*a* ceases energizing stepper motor 82, and spring 96 (FIGS. 6 and 7) causes the heater station 22 to retract to the home or park position illustrated in FIG. 1.

As best illustrated in FIGS. 3 and 11B, the system 14 comprises a mechanical switch 280 which senses when the heater 22 is in the fully retracted position illustrated in FIG. 1 or in the extended position illustrated in FIG. 2. The switch 280 is used to switch the temperature controller between two predetermined set points depending on the position of the heater 22. If the heater 22 is in the park or home position illustrated in FIG. 1, then switch 280 is inactive and causes the SCR controller 204 to pass current to lamps 68 and 70 until they achieve a resting set point temperature. This enables the lamps 68 and 70 to remain energized while the heater 22 is in the rest or park position to avoid prolonged startup times when the printer 12 is first started. If, on the other hand, the heater 22 is in the operating position illustrated in FIGS. 2 and 3, then the switch 280 is activated or closed and SCR controller 204 provides more power to lamps 68 and 70 to increase the temperature output of the heater 22. At startup the web W is not within the desired sublimation temperature range and needs to be brought up to within that range as quickly as possible. Thus, the switch 280 and SCR controller 204 cooperate to control the output of lamps 68 and 70 until the web W temperature reaches the set point temperature.

As best illustrated in FIGS. 11A–11D, the web sensor 168 comprises the photodiode 260 which cooperates with the phototransistor 258 to sense the presence or absence of the web W as it moves through the sublimation station 14. When the web W is properly positioned between the photodiode 260 and phototransistor 258, the web W will block the light from photodiode 260, thereby indicating the presence of the web W. If the light from the photodiode 260 is received by phototransistor 258, the phototransistor 258 is turned on, thereby indicating that the web W is not in its proper position. The output of the sensor 168 is combined with the output of sensor 60 which operates in a similar manner except that the sensor 60 utilizes the arm of sensor bracket 28 and the aperture 28*a* to sense when the heater 22 is in the operating position (FIGS. 2 and 3), in which case the aperture 28*a* permits the LED 256 to energize the phototransistor 254. The bracket 28 blocks the LED 256 light when not in the operating position.

As mentioned, the output of the sensor 60 is combined with the output of the sensor 168 and this output is provided via line 241 (FIG. 11C) to the analog-to-digital converter 252 (FIG. 11C) which in turn provides three distinct states that are represented by three distinct voltage levels as follows:

| STATE | VOLTAGE LEVEL | HEATER 22 POSITION | WEB W PRESENT? |
|---|---|---|---|
| 1 | >4 VOLTS | PARK | EITHER |
| 2 | >2.5 VOLTS, <4 VOLTS | OPERATING | NO |
| 3 | <2.5 VOLTS | OPERATION | YES |

The thermostat 34 (FIGS. 4 and 11B) is attached as described earlier herein and will interrupt the power provided by SCR controller 204 to the lamps 68 and 70 if the thermostats temperature rating is exceeded. In the embodiment being described, the thermostat 34 is selected to have a temperature rating higher than the operating end of the operating sublimation temperature range.

The process or sequence of operation of the printer 12 in combination with the sublimation station 14, heater 22 and web W temperature control and a procedure for tightening web W will now be described relative to FIGS. 12A–13.

Figure 8:
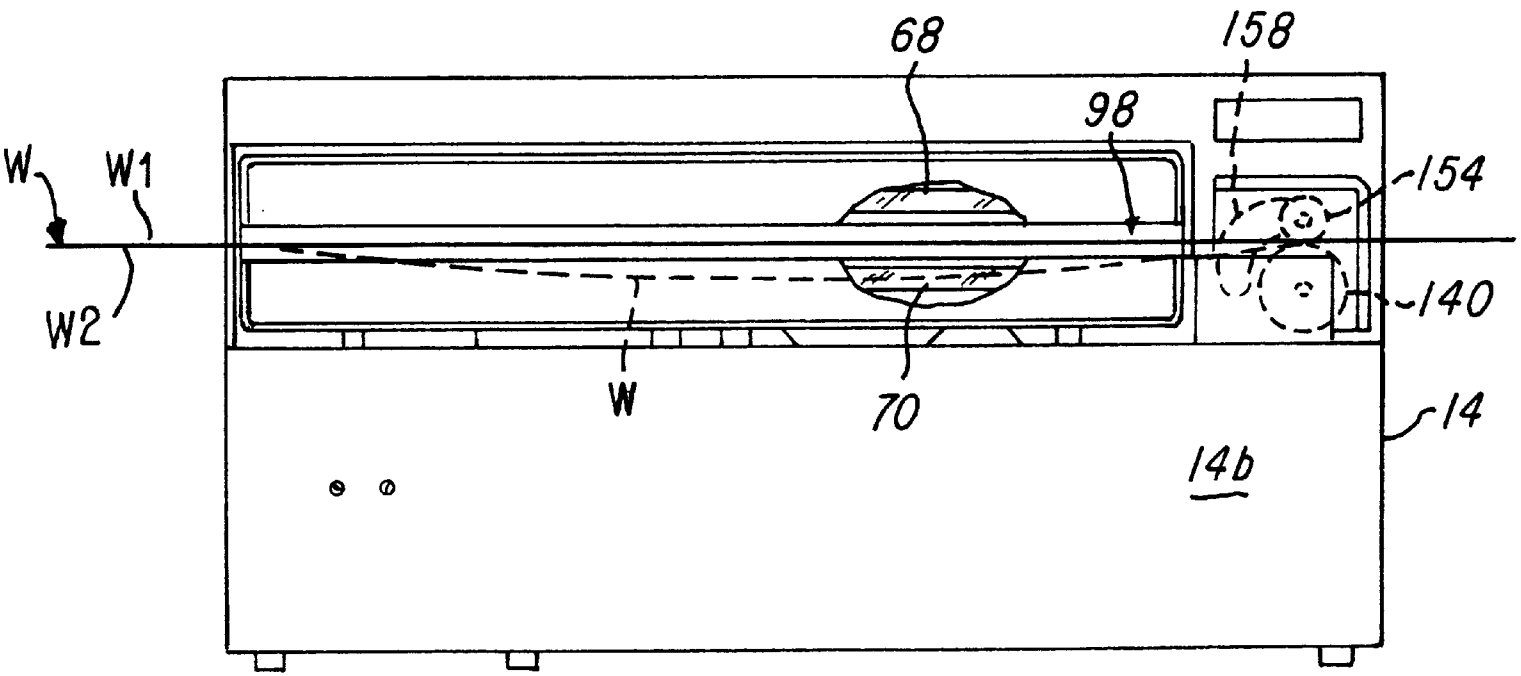
FIG. 8 is a front view of the sublimation station illustrated in FIG. 3.

The web W is supplied from a supply roll 18 (FIG. 1) to printer 12 and an operator threads it to the nip 194 (FIG. 3) between rollers 140 and 154. The operator may initially manually rotate the knob 155 (FIG. 3) to tension the web W. The operator powers the printer 12 and the sublimation station 14 at which time the web W is brought up to the sublimation temperature and the printer 12 may begin applying the at least one sublimation or sublimable dye is applied to either or both the first side W1 or second side W2 of the web W. The feed assembly 138 feeds the web through the nip 194 between driven roll 140 and roller 154. As best illustrated in FIG. 8, it is desirable to provide enough tension on the web W so that the web is situated substantially equidistant from the lamps 68 and 70 as mentioned earlier herein. This facilitates ensuring that the web W does not sag, for example, towards the lamp 70, which would cause side W2 of web W to receive more radiant heat than desired and the side W1 of web W to receive less radiant heat than desired. After the web W is properly tensioned by the operator using a conventional tension knob 155 (FIG. 3), the printer controller 12*a* performs a start-up sequence that will now be described relative to FIGS. 11–13.

Figure 12A:
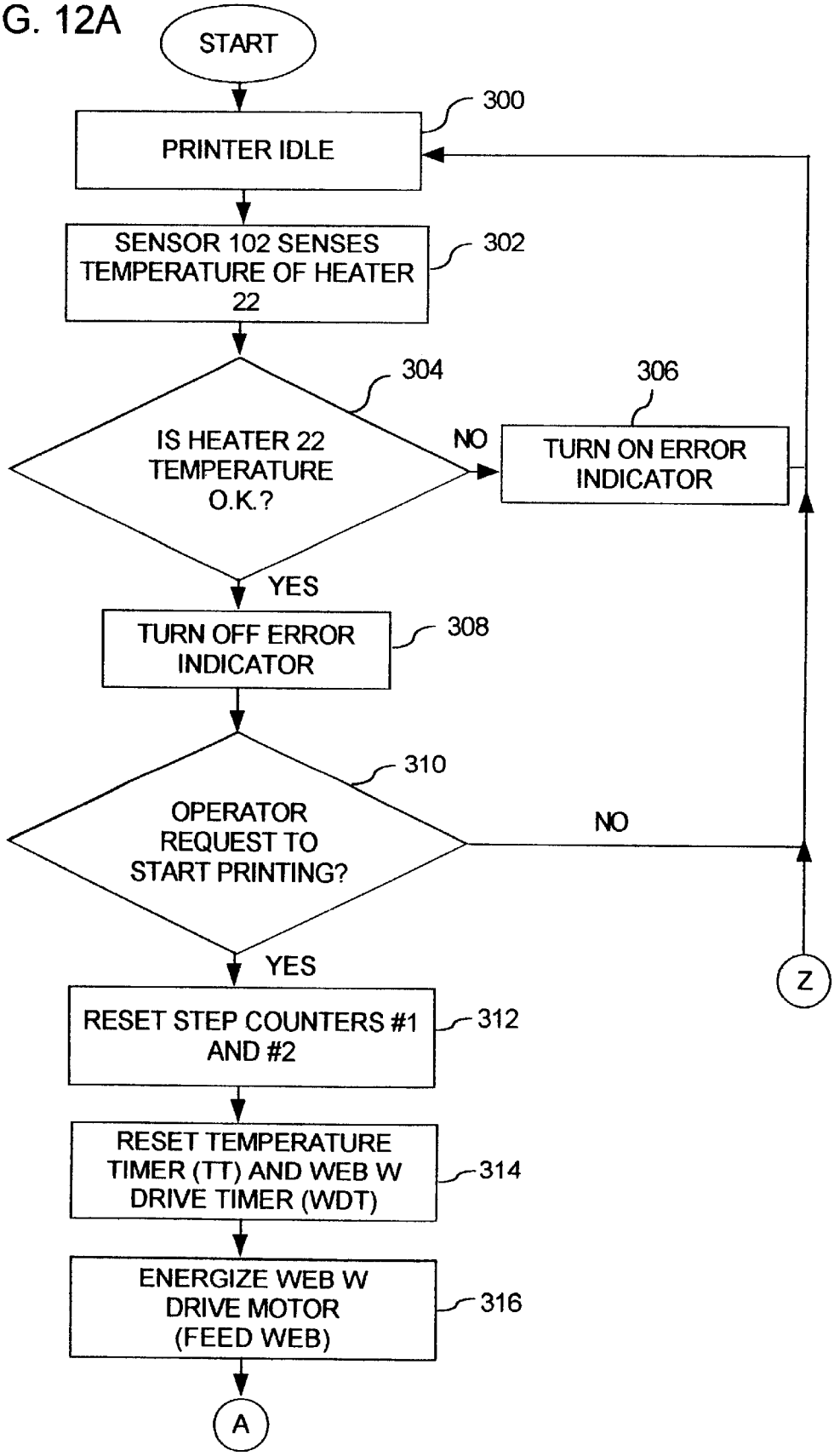
FIGS. 12A–12D are flow charts of a process or routine for controlling the heater temperature and position.
Figure 12B:
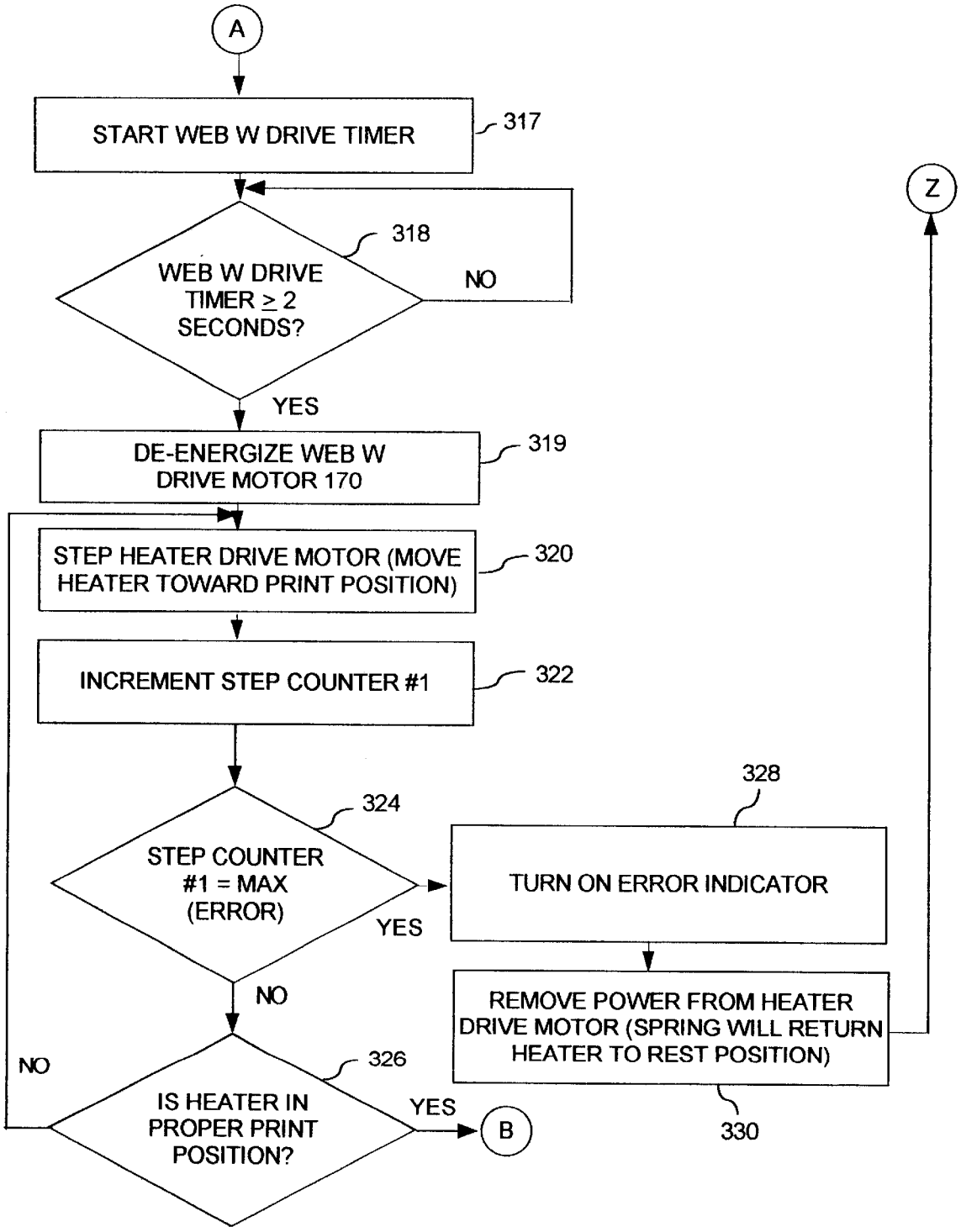

After the operator loads the web W and the printer 12 and sublimation station 14 are powered on, the printer 12 and station 14 are in the idle state as indicated at Block 300 in FIG. 12A. The routine proceeds to decision block 302 where sensor 102 senses the temperature of the heater 22 in the rest position. At decision block 304, it is determined whether the temperature has achieved the park or home temperature set point programmed by the user into controller 72. If it has not, the printer controller 12*a* indicates an error on a printer user interface (not shown) at block 306 and thereafter loops back to the printer idle state at block 300.

If the decision at a decision block 304 is yes, then any previous error indicator is turned off at block 308. If the operator has not requested to start printing, then the routine loops back to the printer idle state at block 300 as shown. After an operator requests to start printing, the routine proceeds to reset a first step counter (not shown) in printer controller 12*a* and a second step counter (not shown) in printer controller 12*a* at block 312. The routine proceeds to block 314 where a temperature timer and web drive timer in printer controller 12*a* are also reset.

Before the printing process begins, a web tightening process may be initiated and a web drive timer (block 317 in FIG. 12B) is started. Next, it is determined whether the web drive timer has exceeded two seconds at decision block 318. If it has not, then the routine loops back as shown. If the web drive timer has met or exceeded two seconds, thereby indicating that the web drive motor 170 has been energized for at least two seconds, then the web W is properly tensioned and the routine proceeds to block 319 where the drive motor 170 is de-energized.

Thereafter, the routine proceeds to block 320 where the printer controller 12*a* begins energizing the stepper motor 82 (FIGS. 7, and 11) to move the heater 22 toward the operating position illustrated in FIGS. 2 and 3. At block 322, the first step counter is incremented and the routine determines at decision block 324 whether the counter has exceeded a maximum count, which corresponds to an error condition, such as, if the heater 22 feed motor 82 is jammed. If it has not, then it is determined whether the heater 22 is in the proper position at decision block 326 and if it is not then the routine loops backs to block 320 as shown. If the decision at block 324 is yes, thereby indicating that the count of the stepper motor has achieved a maximum count (corresponding to a count in excess of a step count needed to drive the heater 22 into the proper position), then the routine proceeds to turn the printer error indicator on at block 328. Thereafter, the routine proceeds to block 330 and printer controller 12*a* removes power from the heater 22 drive motor 82 and the spring 96 (FIG. 7) returns the heater 22 to the rest or home position illustrated in FIG. 1. The routine then returns to the printer idle condition at block 300 in FIG. 12A.

If the decision at block 326 is affirmative (FIG. 12B), meaning that the heater 22 is in the proper position for heating the web W, then the routine proceeds to block 332 and printer controller 12*a* energizes drive motor 82 to step the heater 22 toward the operating position shown in FIGS. 2 and 3. At block 334, the second counter is incremented and the routine proceeds to determine whether the second counter equals ten, which corresponds to the number of counts necessary to get the sensor 60 centered in aperture 28*a*. It should be appreciated that the step count may be higher or lower depending on the characteristics of the aperture 28*a* or stepper motor 82. If the second counter is not equal to ten, then the heater 22 is not in the proper operating position to heat the web W, and the routine loops back to block 332 as shown. If the second counter does equal ten counts, then the aperture 28*a* (FIG. 3) of bracket 28 should be aligned in sensor 60 to permit the diode 256 (FIG. 11) to energize the phototransistor 254 and the sensor 60 should be relatively insensitive to vibration.

It is next determined by sensor 168 whether the web W is present and in the proper position at decision block 338. If it is not, then the error indicator (block 342) on the printer 12 is energized. The printer controller 12*a* further terminates power to the stepper motor 82 (block 346) so that spring 96 (FIG. 7) can return the heater 22 to the home or park position (shown in FIG. 1). Thereafter, the routine loops back to the printer idle condition at block 300 (FIG. 12A).

If the decision at block 338 (FIG. 12C) is affirmative, then the printer controller 12*a* starts the temperature timer TT (not shown) at block 340. It should be appreciated that when the heater 22 is in the operating position illustrated in FIG. 2, the manual switch 280 (FIGS. 3 and 11B) is activated so that the SCR controller 204 (FIG. 11B) sets the temperature setting to the operating temperature set point. Thereafter, the routine proceeds to block 348 (FIG. 12D) where sensor 102 senses a temperature of the web W within the area 98 of the heater 22. At block 350, it is determined whether the web W is at the proper temperature to sublimate the dye which has been printed on one or even both sides W1 and W2 of printer 12. If it is not at the proper temperature, then it is determined (block 352) whether the temperature timer TT is greater than or equal to five seconds, which corresponds to the maximum time required for lamps 68 and 70 to bring the web W up to the proper sublimation temperature mentioned earlier herein. If the temperature timer TT has not achieved at least five seconds, then the routine loops back to block 350. On the other hand, if the temperature timer TT has achieved at least five seconds while the web W is not at the proper temperature to sublimate the at least one sublimation dye, the routine proceeds to block 342 where an error indicator on the printer 12 is again initiated and stepper motor 82 is de-energized and spring 96 returns heater 22 to the home position.

Figure 12C:
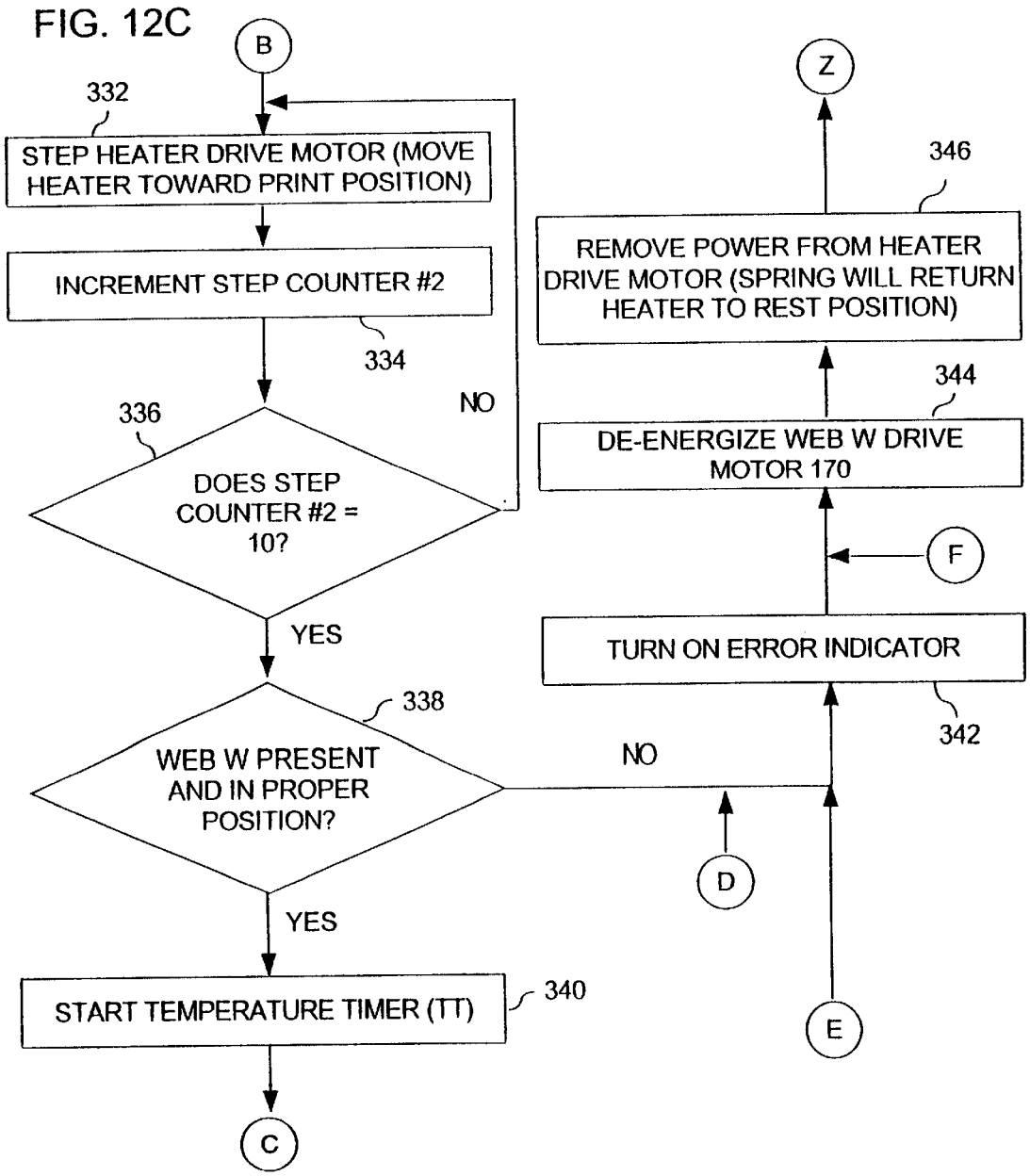
Figure 12D:
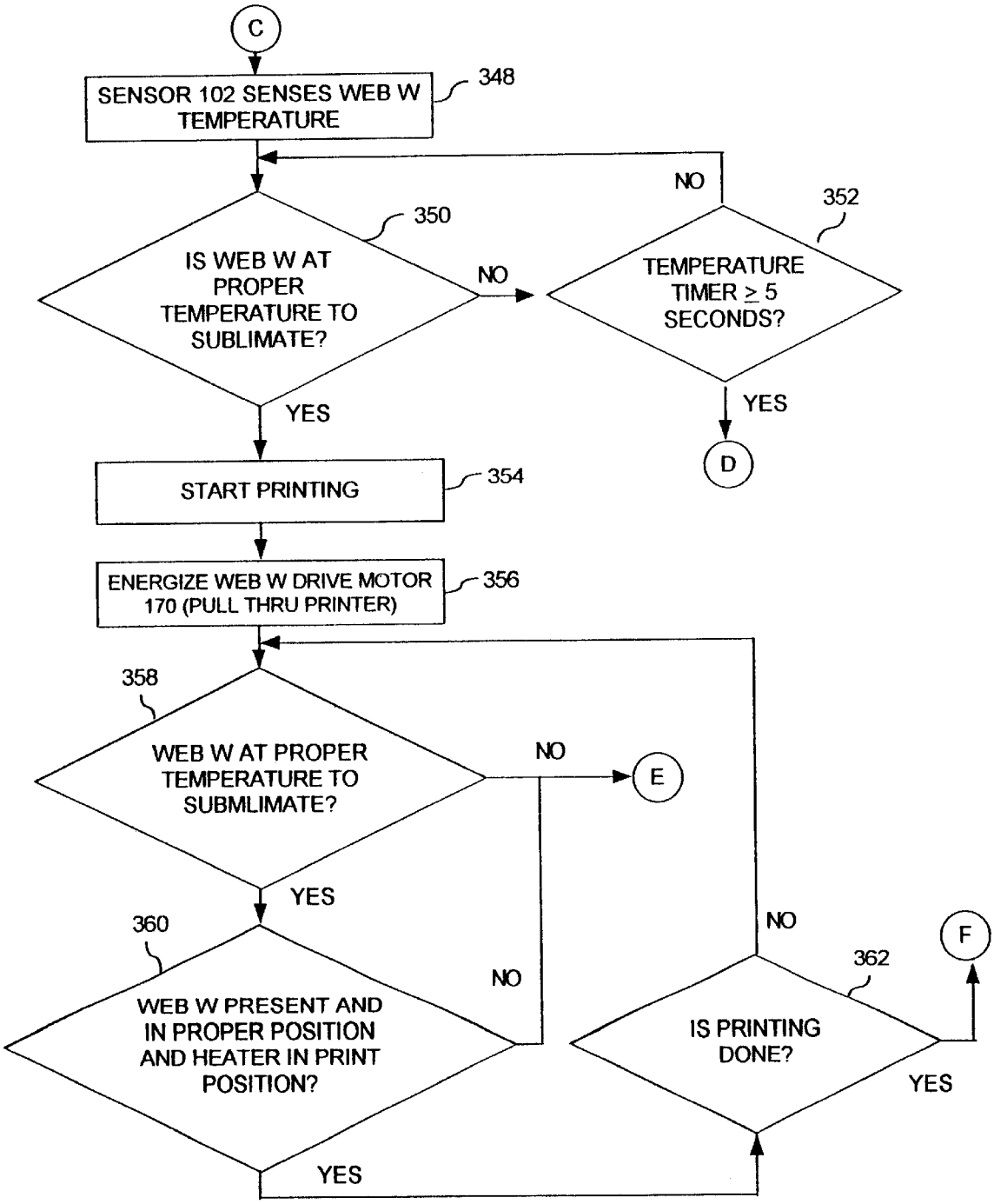

If the decision at decision block 350 is affirmative, then the routine proceeds to block 354 where the printer 12 begins applying the at least one sublimation dye to at least one or both of the sides W1 and W2 of the web W. Thereafter, the web drive motor 170 (decision block 356) is energized to pull the web W through the printer 12 and sublimation station 14. During this time, the sublimation station 14 continuously monitors the temperature of the web W using sensor 102 to ensure that the web W is at a proper temperature to sublimate the at least one sublimation dye. Thus, if it is determined at decision block 358 (FIG. 12D) that the web W is not at the proper temperature to sublimate the at least one sublimation dye, then the routine proceeds to indicate an error indicator or message on the printer 12 when it returns to block 342 (FIG. 12C) as shown. If the web W is at the proper sublimation temperature, the web W is present and in the proper position, and the heater 22 is in the print position (illustrated in FIGS. 2 and 3), then printing is performed. The web W is passed to the stacker 16 where web W is cut by cutter C (FIG. 14) to provide the plurality of labels L. It is then determined whether printing is complete (decision block 356). If it is not, the routine continues to monitor the web temperature and returns to decision block 358. If the printing is complete, then the routine returns to block 344 (FIG. 12C) where the web drive motor 170 is de-energized and power from the heater drive motor 82 is terminated (block 346). As mentioned earlier, this enables spring 96 (FIG. 7) to return heater 22 to the park position. If the web W is at the proper temperature to sublimate the at least one sublimation dye as determined at decision block 358, but the web W is not present or in the proper position in the heater 22 or the heater 22 is not in the print position, then the routine again generates an error indicator or message and returns to block 342 (FIG. 12C).

The process of controlling the web W temperature will now be described relative to FIG. 13 wherein it is determined at decision block 364 whether heater 22 is in the park position illustrated in FIG. 1. If it is not, then SCR controller 204 (FIG. 11D) sets the temperature set point for the desired operating or web temperature (block 362) using controller 74. If the decision at decision block 364 is affirmative, then the SCR controller 204 sets a heater 22 temperature set point for a desired heater 22 temperature (block 368). As mentioned earlier, the heater 22 temperature is the operating temperature of the lamps 68 and 70 while in the park position.

Figure 13:
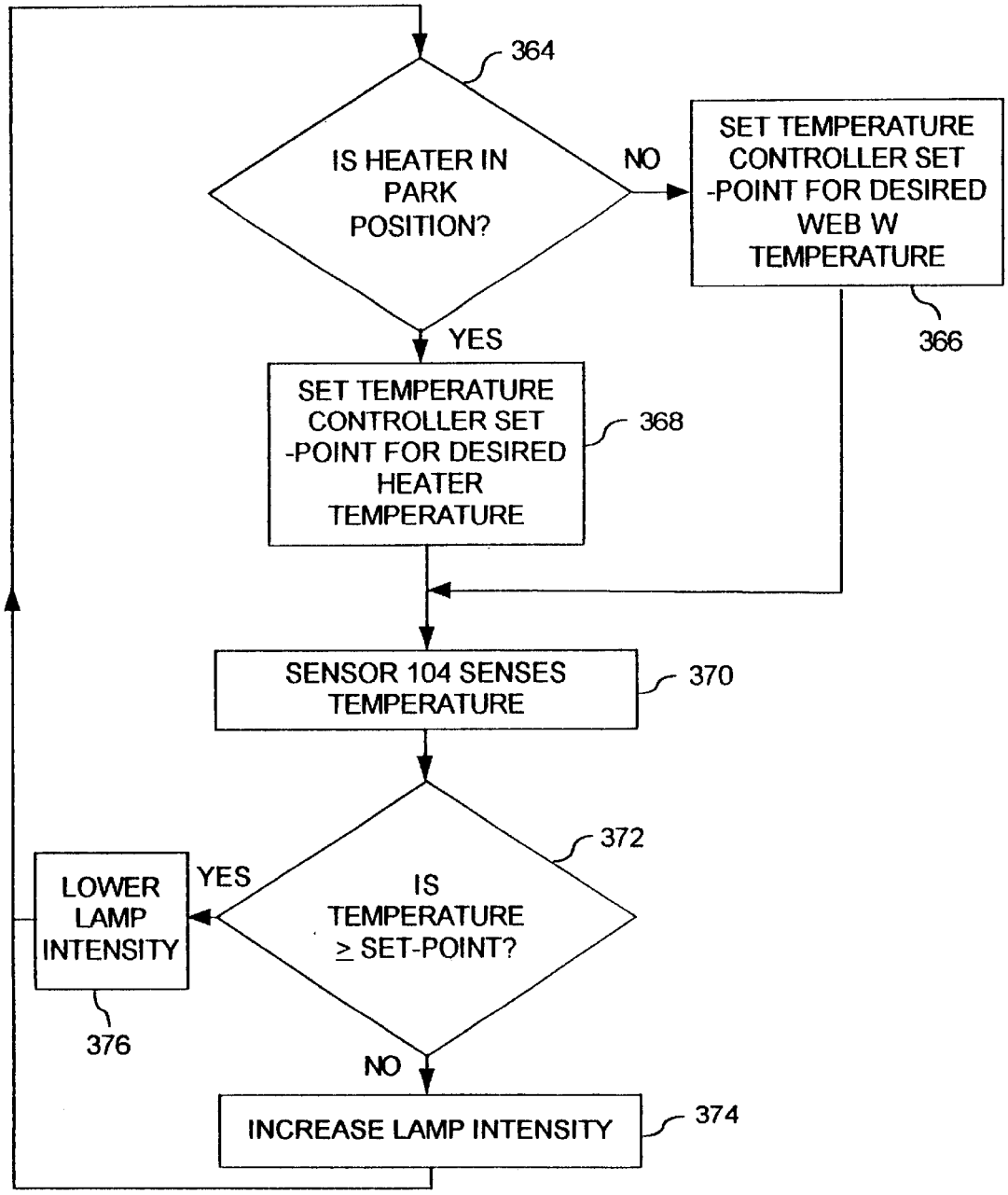
FIG. 13 is another flow chart view illustrating a process or routine for controlling the heater temperature during operation of the sublimation station.

At block 370, the sensor 104 senses the temperature of the web W and controller 72 (FIG. 11A) determines (block 372) in FIG. 13 whether the temperature exceeds the desired set point temperature. If it does not, then SCR controller 204 increases the lamp intensity (block 374). If the web temperature equals or exceeds the desired set point temperature, then the controller 204 (FIG. 11B) decreases power to the lamps 68 and 70 to lower the lamp intensity (block 376). After increasing or decreasing the lamp intensity at blocks 374 and 376 the routine loops back to decision block 364 as shown.

Advantageously, this system and method provides means for controlling the position of the heater 22 and the temperature generated by the heater 22 so that a web temperature of the web W will be maintained at substantially the desired sublimation temperature or within a desired sublimation temperature range. This system and method further facilitate bringing the web temperature up to the desired sublimation temperature or within the sublimation temperature range before the web W moves through the sublimation station 14.

Moreover, it has been found that as the web W moves from a printer end 22*e* to the stacker end 22*f*, the sublimable dye will be sublimated approximately midway through the heater 22. It has been found that the additional time that the web W is exposed to the lamps 68 and 70 of heater 22 as the web W travels from midway through the lamps to the end 22*f* facilitates ensuring that the at least one sublimable dye that is printed on one or both sides of web W has been properly sublimated.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A system for sublimating at least one sublimation dye on at least one side of a web, comprising:

a controller for controlling operation of a sublimation station, a heater coupled to said controller and spaced from the web for heating said web to a sublimation temperature to sublimate said at least one sublimation dye as said web is fed through said system, at least one sensor for sensing a temperature representative of the web temperature, said controller energizing said heater in response to said sensor to maintain said web temperature at substantially said sublimation temperature, a first drive motor under control of said controller and coupled to said heater for driving said heater between a heating position during which said heater is situated in spaced operative relationship to the web to heat the web and a park position at which said heater does not heat the web, and wherein said at least one sensor is also coupled to said drive motor so that the heater can be driven towards and away from said web.

2. The system as defined in claim 1, wherein said heater is driven from said operating position to said park position upon the occurrence of at least lone of the following events: an absence of the web, a signal from a printer upstream of said sublimation system indicating that the printer is stopped, an ink roller in said printer is depleted, a job is over, a full stacker downstream of said sublimation system, said heater not being in operative relationship with said web after said heater is driven to said heating position, or termination of power to said sublimation system.

3. The system as defined it claim 2, wherein said system comprises a jam sensor coupled to said controller for sensing an absence of the web, said controller causing said heater to be driven away from said web in response to said jam sensor.

4. The system as defined in claim 1, wherein said system comprises another sensor coupled to said controller for sensing when said heater is in said heating position and said park position.

5. The system as defined in claim 1, wherein said system comprises an exhaust system coupled to said controller for exhausting vapor as said at least one sublimation dye is sublimated.

6. The system as defined in claim 1, wherein said system comprises a drive roll coupled to the drive motor and an idler roll that cooperates with said drive roll to feed the web through said heater and said sublimation system in a substantially straight path.

7. The system as defined in claim 1, wherein said at least one sublimation dye is prinked on both sides of the web and defines a plurality of prided patterns defining a plurality of labels.

8. The system as defined in claim 1, wherein said heater sublimates said at least one sublimation dye on both sides at substantially the same time.

9. The system as recited in claim 1, wherein said web is fed through said system in a plane in a first direction and said drive motor drives said heater in the plane in a second direction transverse to the first direction.

10. A system for sublimating at least one sublimation dye on at least one side of a web, comprising:

a controller for controlling operation of a sublimation station, a heater coupled to said controller and spaced from the web for heating said web to a sublimation temperature to sublimate said at least one sublimation dye as said web is fed through said system, at least one sensor for sensing a temperature representative of the web temperature, said controller energizing said heater in response to said sensor to maintain said web temperature at substantially said sublimation temperature, a first drive motor under control of said controller and coupled to said heater for driving said heater between a heating position during which said heater is situated in spaced operative relationship to the web to heat the web and a park position at which said heater does not beat the web, and at least one second sensor coupled to said controller for sensing temperatures representative of a web temperature and of a heater temperature when said heater is in said heating or park positions, respectively.

11. The system as defined in claim 10, wherein said heater is driven from said operating position to said park position upon the occurrence of at least one of the following events: an absence of the web, a signal from a printer upstream of said sublimation system indicating that the printer is stopped, an ink roller in said printer is depleted, a job is over, a full stacker downstream of said sublimation system, said heater not being in operative relationship with said web after said heater is driven to said heating position, or termination of power to said sublimation system.

12. The system as defined in claim 11, wherein said system comprises a jam sensor coupled to said controller for sensing an absence of the web, said controller causing said heater to be driven away from said web in response to said jam sensor.

13. The system as defined in claim 10, wherein said system comprises another sensor coupled to said controller for sensing when said heater is in said heating position and said park position.

14. The system as defined in claim 10, wherein said system comprises an exhaust system coupled to said controller for exhausting vapor as said at least one sublimation dye is sublimated.

15. The system as defined in claim 10, wherein said system comprises a drive roll coupled to a drive motor and an idler roll that cooperates with said drive roll to feed the web through said heater and said sublimation system in a substantially straight path.

16. The system as defined in claim 10, wherein said at least one sublimation dye is printed on both sides of said web and defines a plurality of printed patterns defining a plurality of labels.

17. The system as defined is claim 16, wherein said heater sublimates said at least one sublimation dye on both sides at substantially the same time.

18. The system as recited in claim 10, wherein said system further comprises at least one biasing member for biasing said heater to said park position when power to said drive motor is terminated.

19. The system as recited in claim 10, wherein said web is fed through said system in a first plane and said drive motor drives said heater in a second plane, said first and second planes being parallel.

20. The system as recited it claim 10, wherein said at least one sensor is driven towards said web to measure a temperature representative of the web temperature.

21. A sublimation station, comprising:

a frame, a heater drivably mounted on said frame, said heater comprising a heating area for receiving a web having at least one sublimation dye, said heater being in spaced relation to said web and heating said web to a sublimation temperature to sublimate said at least one sublimation dye, a controller coupled to said heater for controlling operation of said heater, at least one sensor coupled to said controller for sensing a temperature representative of the web temperature and generating a web temperature signal in response thereto, said controller energizing said heater in response to said sensor to maintain said web temperature at substantially said sublimation temperature, a drive motor coupled to said heater and coupled to said controller, said controller energizing said drive motor to drive said heater between a park position during which said web is not in operative relationship with said heater and a heating position during which said heater is in spaced operative relationship to said web, and a heater position sensor coupled to said controller for sensing when said heater is in said heating position.

22. The sublimation station as recited in claim 21, wherein said sublimation station further comprises a web sensor coupled to said controller, said web sensor sensing a web jam or absence of said web.

23. The sublimation station as recited in claim 21, wherein said sublimation system further comprises a web presence sensor coupled to said controller for sensing the presence of the web in said sublimation station.

24. The sublimation station as recited in claim 21, wherein said sublimation station further comprises a web drive motor, said controller energizing said web drive motor to drive said web at substantially the same rate as the web is printed on by a printer upstream of said sublimation station.

25. A printing system for printing a plurality of labels, comprising:

a printing station for applying at least one sublimable dye to at least one side of said web;

a sublimation station situated downstream of said printing station, said sublimation station comprising a controller for controlling operation of said sublimation station, a heater coupled to said controller and spaced from the web for heating said web to a sublimation temperature to sublimate said at least one sublimable dye on said web, at least one sensor for sensing a temperature representative of the web temperature, and said controller energizing said heater in response to said sensor to maintain said web temperature at substantially said sublimation temperature, and a heater position sensor coupled to said controller for sensing a position of said heater and generating a heater position signal in response thereto.

26. The printing system as defined in claim 25, wherein said sublimation station comprises an absence sensor for sensing an absence of the web or a web jam, said sublimation station including a driver for causing said heater to be moved to said park position in response to a signal from said absence sensor.

27. A method for sublimating at least one sublimation dye on a web, comprising:

moving a heater from a park position to an operating position at which said heater is in spaced relation to the web, sensing a temperature representative of the web temperature using a sensor, feeding the web through the heater, energizing said heater to beat the web to a desired sublimation temperature to sublimate said dye, moving the sensor towards and away from said web as the heater is moved.

28. The method for sublimating as recited in claim 27, including performing said moving steps simultaneously.

29. The method for sublimating as recited in claim 28, including varying power to said heater to maintain said web temperature at a predetermined web temperature.

30. The method for sublimating as recited in claim 27, including varying power to said heater to maintain said web temperature at said desired sublimation temperature.

31. The method for sublimating as recited in claim 27, including using an infrared sensor to perform said sensing stop.

32. The method for sublimating as recited in claim 27, including sensing a temperature representative of the web temperature with a second sensor, and energizing a web drive motor to feed the web through the heater.

33. The method for sublimating as recited in claim 32, wherein said second sensor comprises an infrared sensor.

34. The method for sublimating as recited in claim 27, including a first lamp and a second lamp in opposed relation to said first lamp, driving said heater to cause said web to be situated between said first and second lamps.

35. A method for sublimating at least one sublimation dye on a web, comprising:

moving a heater from a park position to an operating position at which said heater is in spaced relation to the web, sensing a temperature representative of the web temperature, feeding the web through the heater, energizing said heater to heat the web to a desired sublimation temperature to sublimate said eye, wherein said heater further comprises a first lamp and a second lamp in opposed relation to said first lamp, and said moving of said heater causing said web to be situated between said first and second lamps.

36. The method for sublimating as recited in claim 35, wherein said first and second lamps comprise infrared lamps.

37. A method for sublimating at least one sublimation dye on a web, comprising moving a heater from a park position to an operating position at which said heater is in spaced relation to the web, sensing a temperature representative of the web temperature, feeding the web through the heater, energizing said heater to heat the web to a desired sublimation temperature to sublimate said dye, sensing said heater position with a position sensor, and causing said heater to move to said rest position if said heater is not sensed by said position sensor to be in the operating position.

38. The method for sublimating as recited in claim 37, including sensing a web absence with an absence sensor, and driving said heater to a rest position in response thereto.

39. A method for sublimating at least one sublimation dye on a web, comprising:

moving a heater from a park position to an operating position at which said heater is in spaced relation to the web, sensing a temperature representative of the web temperature with a sensor, feeding the web through the heater, engaging said heater to heat the web to a desired sublimation temperature to sublimate said dye, and the sensor being in fixed relation to said heater, simultaneously driving said sensor and said heater between said park and operating positions.

40. A method for sublimating at least one sublimation dye on a web, comprising moving a heater from a park position to an operating position at which said heater is in spaced relation to the web, sensing a temperature representative of the web temperature, and feeding the web in a first plane through the heater, energizing said heater to heat the web to a desired sublimation temperature to sublimate said dye, moving the heater in a second plane from said park position to said operating position, and said first plane being parallel to said second plane.

41. A method for printing labels, comprising:

printing at least one sublimable dye on a web of material as the web moves through a printing station, said sublimable dye defining a plurality of label patterns, sublimating said at least one sublimable dye using a heater in spaced relation to said web of material, said heater being energized to heat the web sufficiently to sublimate said at least one sublimable dye, and driving said heater into operative relationship with said web of material before said sublimating step.

42. The method as recited in claim 41, including retracting said heater upon the occurrence of at least one of the following events: an absence of the web, a signal from a printer upstream of said sublimation system indicating that the printer is stopped, an ink roll in said printer is depleted, a job is over, a full signal from a stacker downstream of said sublimation system, termination of power to said sublimation system, or said sensed web temperature varies from said sublimation temperature by a predetermined threshold.

43. The method as recited in claim 41, including:

biasing said heater to a park position, and driving said heater from said park position to a heating position during which said heater becomes opposed to and spaced from said web.

44. The method for sublimating as recited in claim 43, including moving said heater away from said web in response to a web absence.

45. The method for printing a plurality of labels according to claim 44, including moving said heater toward a park position in the event of said sensed web absence.

46. The method for printing a plurality of labels according to claim 45, including performing said moving step using a spring.

47. A method for printing labels, comprising:

printing at least one sublimable dye on a web oil material as the web moves through a printing station, said sublimable dye defining a plurality of label patterns, sublimating said at least one sublimable dye using a heater in spaced relation to said web of material, said heater being energized to heat the web sufficiently to sublimate said at least one sublimable dye, cutting said web of material to provide a plurality of labels, sensing a temperature representative of the web temperature after the heater is in operative relationship with said web, controlling said heater to maintain said temperature at substantially the sublimation temperature, and controlling movement of said web through said heater in response to said sensed temperature.

48. A method for printing a plurality of labels comprising at least one sublimation dye, comprising:

printing at least one sublimation dye on at least one side of a web to define, said plurality of labels, driving a heater into operative and spaced relationship with said web, sensing a temperature representative of the web temperature with a first sensor, energizing said heater in response to said first sensor in order to maintain said temperature within a desired sublimation temperature range as the web is fed passed the heater, sensing an initial temperature representative of the web temperature with a second sensor, and energizing a web feed motor to feed the web through said heater.

49. The method for printing a plurality of labels according to claim 43, including:

using said second sensor to sense a heater temperature when said heater is in a park position.

50. The method for printing a plurality of labels according to claim 48, wherein said first and second sensors are infrared sensors.

51. The method for printing a plurality of labels according to claim 48, including:

sensing if said heater is not in operative relationship with said web, and moving said heater away from said web if said heater is sensed not to be in said operative relationship.

52. A printing system for printing a sublimation dye on a web and sublimating the dye, comprising: a printer for printing a sublimation dye on a web, a sublimation station having a heater for sublimating the dye, a motor-driven roll for moving the web along a path in a plane from the printer through the sublimation station, the heater being mounted for movement in a plane generally laterally of the path between a rest position spaced from the web and a heating position in dye-sublimating relation to the web, a motor for moving the heater from the rest position to; the heating position, and means for biasing the heater to the rest position.

53. A printing system for printing a sublimation dye on a web and sublimating the dye, comprising: a printer for printing a sublimation dye on a web, a sublimation station having a heater for sublimating the dye, a motor-driven roll for moving the web along a path in a plane from the printer through the sublimation station, the heater being mounted for movement in a plane generally laterally of the path between a rest position spaced from the web and a heating position in dye-sublimating relation to the web, a motor for moving the heater from the rest position to the heating position, and a spring for biasing the heater to the rest position.

* * * * *

UNITED STATES PATENT AND TRADEMARK OFFICE

CERTIFICATE OF CORRECTION

PATENT NO. : 6,698,958 B2 
DATED : March 2, 2004
INVENTOR(S) : Monti Emery, Scott Chilson and David Whitley It is certified that error appears in the above-identified patent and that said Letters Patent is hereby corrected as shown below:

Title page,
Item [56], References Cited, OTHER PUBLICATIONS, delete "Machine translation of JP 09013284 A from Japanese Patent Office website" and "Machine translation of JP 09013284 from Japanse Patent Office website"

Column 14,
Line 22, after "at least" delete "lone" and insert -- one --.
Line 30, after "as defined" delete "it" and insert -- in --.
Line 48, after "dye is" delete "prinked" and insert -- printed --.
Line 49, after "plurality of" delete "prided" and insert -- printed --.

Column 15,
Line 9, first word, delete "beat" and insert -- heat --.

Column 16,
Line 66, after "heater to" delete "beat" and insert --heat --.

Column 17,
Line 34, after "sublimate said" delete "eye" and insert -- dye --.

Column 18,
Line 59, after "on a web" delete "oil" and insert -- of --.

Column 19,
Line 25, "43" should be -- 48 --.

UNITED STATES PATENT AND TRADEMARK OFFICE

CERTIFICATE OF CORRECTION

PATENT NO. : 6,698,958 B2 
DATED : March 2, 2004
INVENTOR(S) : Monit Emery, Scott Chilson and David Whitley It is certified that error appears in the above-identified patent and that said Letters Patent is hereby corrected as shown below:

Column 20,
Line 16, after "rest position" delete ";".

Signed and Sealed this

Sixteenth Day of November, 2004

JON W. DUDAS
*Director of the United States Patent and Trademark Office*